US007680399B2

(12) United States Patent
Buchanan et al.

(10) Patent No.: US 7,680,399 B2
(45) Date of Patent: Mar. 16, 2010

(54) SYSTEM AND METHOD FOR PRODUCING AND DELIVERING VAPOR

(75) Inventors: Daryl Buchanan, Allen, TX (US); Faisal Tariq, Allen, TX (US); Hai Mei, Plano, TX (US); Stuart Tison, McKinney, TX (US)

(73) Assignee: Brooks Instrument, LLC, Hatfield, PA (US)

( * ) Notice: Subject to any disclaimer, the term of this patent is extended or adjusted under 35 U.S.C. 154(b) by 942 days.

(21) Appl. No.: 11/349,068

(22) Filed: Feb. 7, 2006

(65) Prior Publication Data

US 2007/0181703 A1 Aug. 9, 2007

(51) Int. Cl.
*A01G 13/06* (2006.01)

(52) U.S. Cl. ..... 392/387; 392/386

(58) Field of Classification Search ..... None
See application file for complete search history.

(56) References Cited

U.S. PATENT DOCUMENTS 4,235,829 A 11/1980 Partus
4,314,837 A 2/1982 Blankenship
4,582,480 A 4/1986 Lynch et al.
4,842,827 A 6/1989 Graf et al.
4,867,375 A 9/1989 Ueki et al.
5,698,037 A 12/1997 Stauffer
5,832,177 A 11/1998 Shinagawa et al.
5,835,678 A 11/1998 Li et al.
5,851,302 A 12/1998 Solis
5,868,159 A 2/1999 Loan et al.
5,882,416 A 3/1999 Van Buskirk et al.
5,925,577 A 7/1999 Solis
5,966,499 A 10/1999 Hinkle et al.
5,968,587 A 10/1999 Frankel (Continued)

FOREIGN PATENT DOCUMENTS

EP 0651437 A2 3/1995

(Continued)

OTHER PUBLICATIONS

Victor Vartanian, Laurie Beu, Tab Stephens, Jason Rivers, Benny Perez, Eric Tonnis, Mark Kiehlbauch, David Graves; Long Term Evaluation of the Litmas "Blue" Plasma Device for Point-of-Use Perfluorocompound and Hydrofluorocarbon Abatement; May 3, 2000; pp. 1-52.

(Continued)

*Primary Examiner*—Thor S Campbell
(74) *Attorney, Agent, or Firm*—Sonnenschein Nath & Rosenthal LLP

(57) ABSTRACT

Systems and methods for producing and delivering vapor are disclosed. A vaporizer tank containing a liquid may be heated such that liquid within the tank is heated and vapor generated. The flow of this vapor to a destination may then be regulated. Embodiments of the present invention may control the temperature of this liquid such that a saturated vapor condition is substantially maintained in the vaporizer tank. The vaporizer tank is coupled to a mass flow controller which regulates the delivery of the vapor to downstream components. By substantially maintaining the saturated vapor condition within the vaporizer tank the pressure of vapor at the mass flow controller can be substantially maintained and a stable and consistent flow rate of vapor achieved.

38 Claims, 23 Drawing Sheets

U.S. PATENT DOCUMENTS

| | | | |
|---|---|---|---|
| 6,169,852 | B1 | 1/2001 | Liao et al. |
| 6,199,298 | B1 | 3/2001 | Bergman |
| 6,258,170 | B1 | 7/2001 | Somekh et al. |
| 6,269,221 | B1 | 7/2001 | Horie et al. |
| 6,335,284 | B1 | 1/2002 | Choi et al. |
| 6,409,839 | B1 | 6/2002 | Sun et al. |
| 6,473,563 | B2 | 10/2002 | Takamatsu et al. |
| 6,494,957 | B1 | 12/2002 | Suzuki |
| 6,604,493 | B1 | 8/2003 | Toki |
| 6,631,334 | B2 | 10/2003 | Grosshart |
| 6,790,475 | B2 | 9/2004 | Yoo |
| 6,895,178 | B2 | 5/2005 | Gu et al. |

FOREIGN PATENT DOCUMENTS

KR 1020030046705 A 6/2003

OTHER PUBLICATIONS

Eric J. Tonnis, Victor Vartanian, Laurie Beu, Tom Lii, Rusty Jewett, David Graves; International Sematech-Evaluation of a Litmus "Blue" Point-of-Use Plasma Abatement Device for Perflurocompund Destruction; Dec. 15, 1998; pp. 1-31.

MKS Instruments-Vapor on Demand Module-An Integrated Component Subsystem that incorporates Vaporization and Pressure-Based Mass Flow Control in a Single Unit; Oct. 1997; pp. 1-4; Wilmington, MA.

MKS Instruments-Flow Measurement and Control-VoDM- Vapor on Demand Module; Aug. 2002; pp. 1-4; Wilmington,MA.

MKS Instruments-Flow Measurement and Control- Type DL125-C-Direct Liquid Injection Subsystem; Mar. 2003; pp. 1-4; Wilmington, MA.

Tylan General- VC-4900 Series Vapor Flow Controller; pp. 1-2; San Diego, CA.

MKS Instruments-Flow Measurement and Control-Type 1150C, Type 1152C; Jun. 2002; pp. 1-4; Wilmington, MA.

Donald Higgins, Brady Cole, John Tracy, Ricky Ruffin; Solid State Technology- Strip, Etch, and RTP benefit from Integrated Water-Vapor Delivery; Feb. 2001; pp. 1-4.

Applied Materials, Metal Etch Centura$^{R}$ Vapor Delivery System (VDS) Manual, Jul. 1997.

Saleem et al., "Catalytic Steam-Generation System for Advanced Semiconductor Processing", Semiconductor Fabtech, 19$^{th}$ Edition, pp. 1-5.

| Fig. 8A |
|---|
| Fig. 8B |

| Flow %FS | Setpoint Nitrogen sccm | Setpoint Plus 1% Reading | Setpoint Minus 1% Reading | Acutal Mol-bloc sccm |
|---|---|---|---|---|
| 100% | 1142 | 1153 | 1130 | 1140 |
| 75 | 856 | 865 | 848 | 855 |
| 50 | 571 | 576 | 565 | 573 |
| 25 | 285 | 288 | 283 | 284 |
| 10 | 114 | 115 | 113 | 114 |
| 0 | | | | |

FIG. 20

SYSTEM AND METHOD FOR PRODUCING AND DELIVERING VAPOR

TECHNICAL FIELD OF THE INVENTION

This invention relates generally to vapor delivery systems. More particularly, embodiments of the present invention relate to efficient vapor delivery systems. Even more particularly, embodiments of the present invention relate to stable, high-flow rate vapor delivery systems operating at sub-atmospheric conditions.

BACKGROUND OF THE INVENTION

There are many applications for which delivery of vapor of different types of liquids is desired. In semiconductor processing, for example, it may be desired to deliver photochemicals, such as photoresist chemicals, in vapor form to a process chamber to control the amount and rate at which these photochemicals are applied to a semiconductor wafer. Moreover, the use of many of these photochemicals may result in the production of less than desirable byproducts. To deal with these harmful byproducts and clean a process chamber of these byproducts or other chemicals before another processing stage, water vapor may be delivered to the process chamber. The water vapor may be used to convert these byproducts to less reactive compounds which are more easily disposed of through a chemical reaction.

Both delivering chemicals to a process chamber and the delivery of water vapor to a process chamber in order to react with process byproduct require precise delivery of vapor of different types. To that end, many types of systems have been designed and utilized to deliver vapor at precisely controlled flow rates and pressures for use in a variety of applications.

A typical vapor delivery system, such as one that may be used for delivery of water vapor to a process chamber, employs a vaporizer chamber. At least some portions of this vaporizer chamber are kept at a temperature high enough to vaporize liquid water substantially instantaneously when the liquid water contacts these portions (e.g. 125° C.). The delivery of the vapor formed through this instantaneous vaporization is then controlled with one or more flow controllers.

This type of system has many drawbacks, however. First and foremost, because the vaporization chamber of these types of systems must be maintained at a relatively high temperature these types of systems are relatively inefficient. Part and parcel with this problem, is the problem of condensation. As the water vapor is usually at a relatively high temperature, systems of the type described usually require that components in the flow path of the vapor be maintained at a higher temperature (e.g. 140° C.) than the vapor itself so condensation does not form in the flow path. Not only does this requirement entail higher energy consumption for such systems, but additionally, these higher temperatures may affect the reliability and stability of system components while making the use of such systems hazardous to technicians or other operators.

The use of these high temperatures has other adverse effects as well. By vaporizing the liquid at a higher temperature contaminants within the liquid are more likely to be vaporized, resulting in potential corrosion along the flow path of the vapor, or contamination of the process itself. Additionally, as the flow controllers used to regulate the delivery of vapor may be pressure based mass flow controllers (MFCs), the high temperature used in these systems may cause these pressure based MFCs to drift, affecting the precision with which these systems can regulate the flow of vapor. This drift may be especially prevalent with MFCs that utilize capacitance-based pressure sensors, as in most cases the signal-conditioning electronics are typically positioned very close to the sensors in these types of MFCs.

Other lower temperature systems for delivery vapor have also been tried. These systems suffer from a number of failings as well. The majority of these shortcomings pertain to the inability of these systems to deliver either a high flow rate of vapor or to deliver vapor over long periods of time. In the main, these shortcomings are the result of the conditions required by the majority of these systems to produce vapor, such as that many of these systems may maintain precise equilibrium conditions or that relatively low pressure may need to be applied to create a significant flow of vapor. As a consequence, many of these systems may produce a lower head pressure of vapor, and commensurately be constrained as to the flow rates which they can achieve.

Still other types of systems for the production of water vapor have also been utilized, where the production of water vapor is accomplished by reacting hydrogen and oxygen in the presence of a catalyst. As the reaction utilized to produce vapor in these systems is severely exothermic air-cooling is usually required, making these systems prohibitively expensive for most uses. Additionally, these systems suffer from some of the same problems discussed above. Namely, variation in the reaction used to create water vapor may result in variable flow rates while a single ongoing reaction may not produce the desired flow rate of water vapor.

Thus, as can be seen, systems and methods for the production and delivery of vapor which can maintain consistent, stable and accurate vapor delivery, and which may also operate at sub-atmospheric conditions, are desired.

SUMMARY OF THE INVENTION

Systems and methods for producing and delivering vapor are disclosed. A vaporizer tank containing a liquid may be heated such that liquid within the tank is heated and vapor generated. The flow of this vapor to a destination may then be regulated. Embodiments of the present invention may control the temperature of this liquid such that a saturated vapor condition is substantially maintained in the vaporizer tank. The vaporizer tank is coupled to a mass flow controller which regulates the delivery of the vapor to downstream components. By substantially maintaining the saturated vapor condition within the vaporizer tank the pressure of vapor at the mass flow controller can be substantially maintained and a stable and consistent flow rate of vapor achieved.

In one embodiment, a vaporizer tank may be heated to a first temperature to produce a saturated vapor condition in the vaporizer tank. Vapor can then be flowed from the vaporizer tank while maintaining the temperature of the vaporizer tank.

In another embodiment, a system may comprise a vaporizer tank, heaters for heating the vaporizer tank, a mass flow controller mounted to, or near, the vaporizer tank, heaters for heating the mass flow controller, and a control system operable to control the heaters and the mass flow controller.

In still another embodiment, the vaporizer tank is refilled when the liquid in the tank falls below an operating level. The refill may be accomplished by gating, or controlling the duty cycle of, a fill valve such that the fill valve is substantially opened and closed to minimize the disturbance to the conditions in the vaporizer tank when admitting liquid to the vaporizer tank.

Various and sundry technical advantages may be provided by embodiments of the present invention. For example, certain embodiments of the present invention provide an advantage by allowing an accuracy which is within one percent of reading to be achieved.

Another advantage provided by embodiments of the present invention is a broad range of vapor flow rates. In particular, embodiments of the present invention may provide full scale ranges of 6SLM or higher.

Embodiments of the present invention may also provide the advantage of reduced calibration and setup times coupled with a longer mean time between failures. Calibration for embodiments of the present invention may occur less than once every 6 months, while mean time between failures may exceed 24 months.

The present invention may also have the advantage of reducing contamination in the vapor produced for all metals to less that 1 part per billion (ppb), for Calcium to less than 2 ppb, and for Boron to less than 5 ppb. Thus, the systems and methods of the present invention, in addition to downstream components, may be less affected by contamination.

Reduced size may be another advantage of the present invention. Embodiments of the present invention may provide vapor delivery systems which are 11.25 inches×5.5 inches×8.5 inches, 10 inches×5 inches×9 inches, or smaller.

Embodiments of the present invention may provide an advantage of allowing portions of the vapor delivery system to achieve a set of conditions both more quickly and more efficiently and may allow a finer granularity of control over these operating conditions. For example, heaters may be controlled to within +/−2° C. of a setpoint.

Other embodiments of the present invention provide the technical advantage of a consistent vapor saturation and vapor delivery while operating at sub-atmospheric conditions for better safety. In some embodiments, these advantages may, in part, be achieved by utilizing components that are less affected by the operating conditions of the system, for example a thermal based mass flow controller.

Embodiments of the present invention may also be able to continue delivery of vapor in the event of a temporary interruption to a liquid source by utilizing the liquid remaining in a vaporizer tank.

Additionally, embodiments of the present invention may provide the advantage that pressure within the vapor tank does not have to be lowered for vapor production or delivery to occur.

Certain embodiments of the invention may further have the ability to communicate with external devices and provide valuable data which can be recorded and analyzed. This data may include, but is not limited to, flow, temperature, valve status, etc.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore nonlimiting, embodiments illustrated in the drawings, wherein identical reference numerals designate the same components. Note that the features illustrated in the drawings are not necessarily drawn to scale.

FIG. 20 is a table depicting the accuracy of an embodiment of the present invention.

DETAILED DESCRIPTION

The invention and the various features and advantageous details thereof are explained more fully with reference to the nonlimiting embodiments that are illustrated in the accompanying drawings and detailed in the following description. Descriptions of well known starting materials, processing techniques, components and equipment are omitted so as not to unnecessarily obscure the invention in detail. It should be understood, however, that the detailed description and the specific examples, while indicating preferred embodiments of the invention, are given by way of illustration only and not by way of limitation. Various substitutions, modifications, additions and/or rearrangements within the spirit and/or scope of the underlying inventive concept will become apparent to those skilled in the art from this disclosure.

Before explaining embodiments of the present invention it should be noted that though the specific embodiments of the present invention described herein have been depicted with reference to their use for production and delivery of water vapor embodiments of the present invention may be utilized to produce and deliver vapor from other liquids. Those of ordinary skill in the art will have a conception of how the present invention may utilized in conjunction with these other fluids after reviewing the following disclosure.

Attention is now directed to systems and methods for producing and delivering vapor. A vaporizer tank containing a liquid may be heated such that liquid within the tank is heated and vapor generated from the liquid. The flow of this vapor to a destination may then be regulated. Embodiments of the present invention may control the temperature of this liquid such that a saturated vapor condition is substantially maintained in the vaporizer tank. The vaporizer tank is coupled to a mass flow controller which regulates the delivery of the vapor to downstream components. By substantially maintaining the saturated vapor condition within the vaporizer tank the pressure of vapor at the mass flow controller can be substantially maintained and a stable and consistent flow rate of vapor achieved. These systems and methods may be especially useful for semiconductor fabrication applications such as post etch polymer removal, dry strip processes and delivery of low vapor pressure materials.

Figure 1:
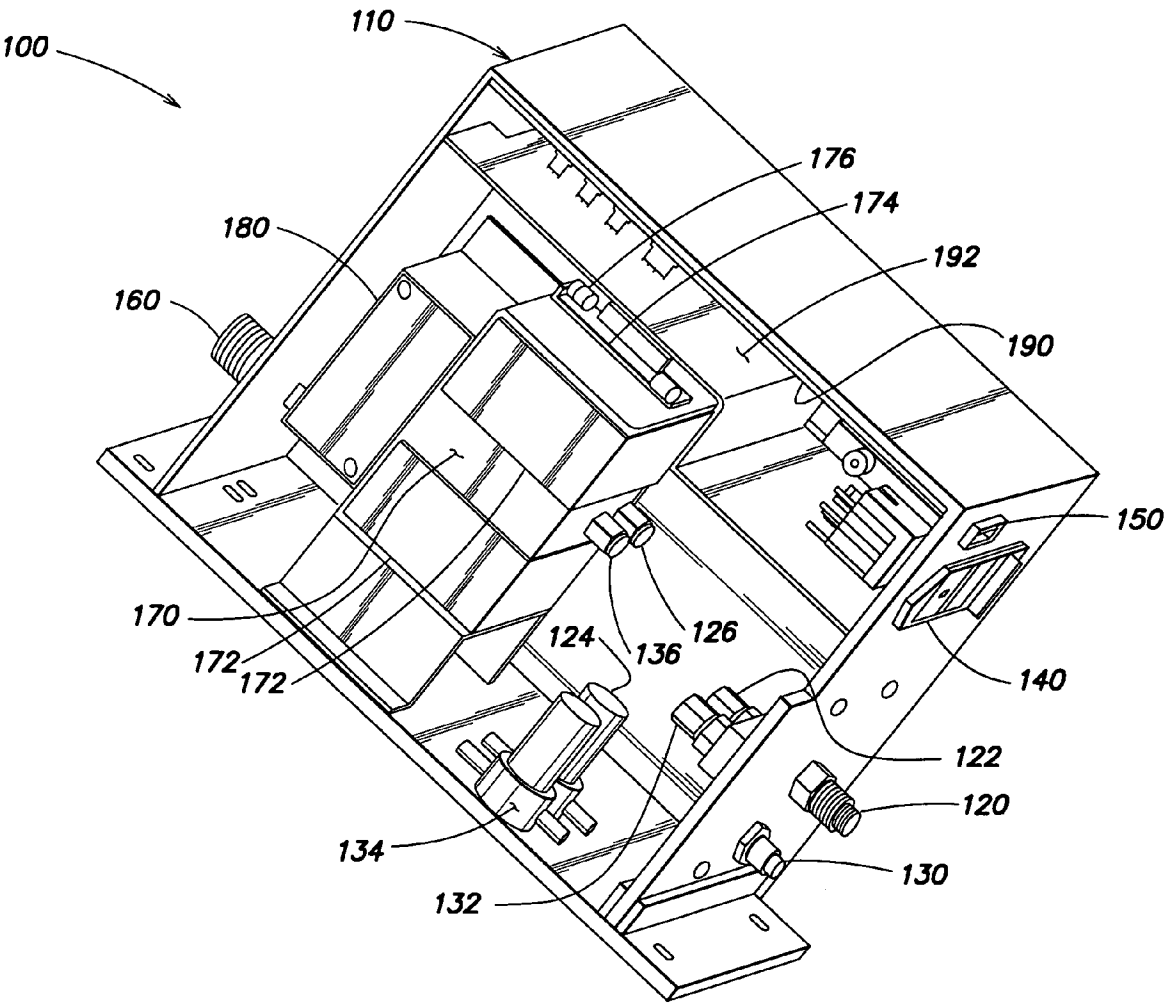
FIG. 1 is a diagrammatic representation of one embodiment of a vapor delivery system.

Turning to FIG. 1, a cutaway diagrammatic representation of one embodiment of just such a vapor delivery system is depicted. Vapor delivery system 100 is contained in case 110 which comprises system inlet 120, drainage port 130, power connection 140, I/O port 150 and vapor outlet 160. System inlet 120 and drainage port 130 may be stainless steel or titanium. Case 110 may be carbon steel to shield any electronics inside case 110 from electromagnetic interference. I/O port 150 may be a communication port through which vapor delivery system 100 may communicate with another system for example, to receive setpoints or communicate errors.

Vaporizer tank 170, mass flow controller 180, and printed circuit board (PCB) 190 comprising digital electronics (which may included embedded control system(s)), reside inside case 110. Vaporizer tank 170 may be coupled to one or more heaters 172. Vapor delivery system may also comprise level sensor 176 which, in one embodiment may comprise PCB 174 having sensors operable in combination with a float (not shown) to sense the level of liquid within vaporizer tank 170.

Vapor delivery system 100 may be coupled to a source of water (usually de-ionized) through system inlet 120, which is in turn coupled to inlet filter 122, dosing valve 124 and eventually to tank inlet 126 of vaporizer tank 170. Drain connection 136 of vaporizer tank 170 is similarly coupled to drainage port 130 via drain valve 134 and drain filter 132. These components may be coupled using platinum or stainless steel tubing, however, plastic tubing may, in some cases, be used to couple drain connection 136 to drainage port 130. Vapor delivery system 100 may also be coupled to a power source through power outlet 140 and may communicate with an external device (e.g. a control system from which it may receive a setpoint) through I/O port 150. Notice that some of the electronics of vapor delivery system 100 may be separated from the liquid flow path by a splash guard 192 which serves to protect these electronics from possible leaks.

Figure 2:
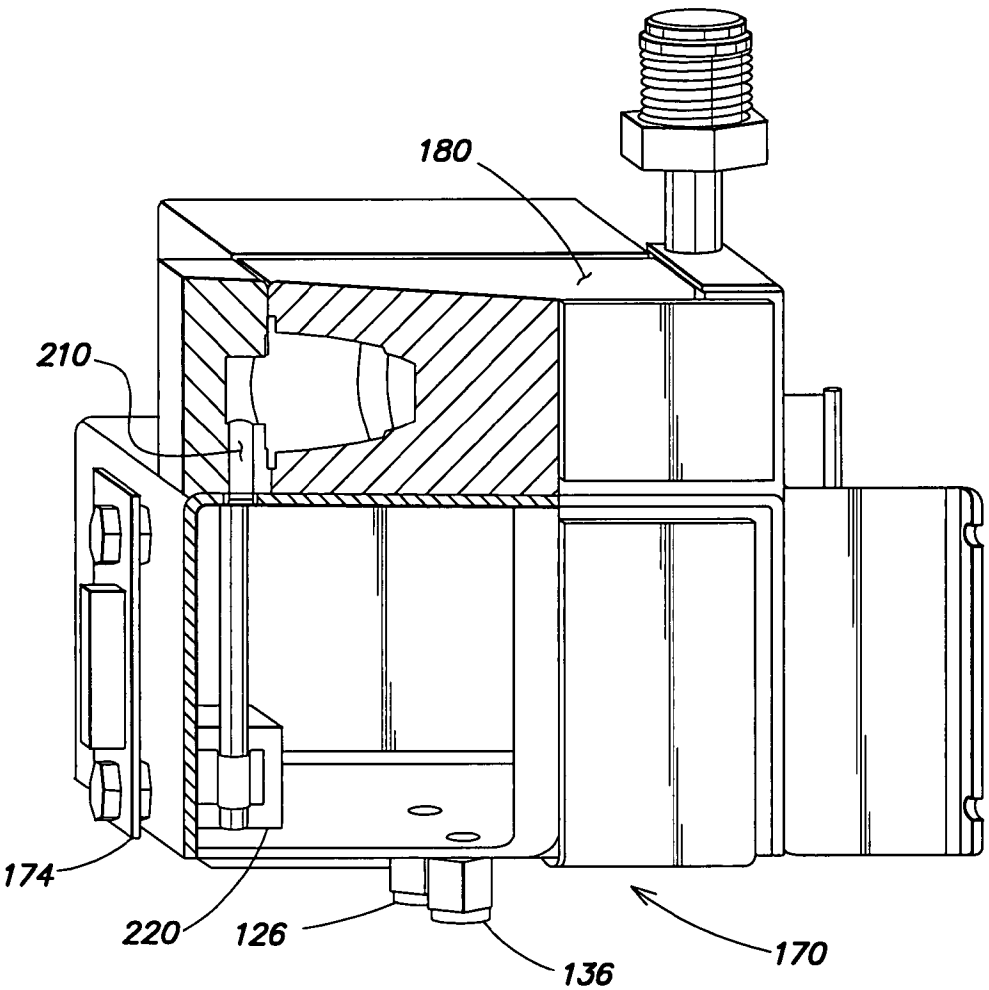
FIG. 2 is a diagrammatic representation of one embodiment of a vaporizer tank and a mass flow controller.

Moving on to FIG. 2, a cutaway view of one embodiment of vaporizer tank 170 and mass flow controller 180 is presented. Vaporizer tank 170 may be made of titanium and have a volume of around 550 ml. A tank wrapper of carbon steel may surround vaporizer tank 170 to protect electronics in or around vaporizer tank 170 from electromagnetic interference. Fittings on vaporizer tank 170 such as tank inlet 126 or drain port 136 may be titanium or stainless steel. Notice that mass flow controller 180, which may be a mass flow controller such as a Tylan thermal-based VC4900 series mass flow controller or another type of mass flow controller (e.g., pressure based MFC), is coupled in close proximity to vaporizer tank 170 and, in some embodiments, may be mounted on vaporizer tank 170 such that vapor outlet 210 of vaporizer tank 170 outlets substantially directly to mass flow controller 180. Because vaporizer tank 170 and mass flow controller 180 are tightly integrated, the overall size of vapor delivery system 100 may be minimized and may serve to reduce plumbing utilized to couple vaporizer tank 170 and mass flow controller 180 such that there is less plumbing on which condensation may form.

Tank inlet 126 and drain port 136 may be located at the bottom of vaporizer tank 170 (relative to the orientation with which vaporizer tank 170 may be utilized in operation) to reduce temperature fluctuations caused to liquid in vaporizer tank 170 during the addition or drainage of liquid to or from vaporizer tank 170. Similarly, to reduce variations in the fill rate, which may be caused by inlet pressure variation, a flow restrictor may be used in conjunction with tank inlet 126. In some embodiments, this flow restrictor may be a 0.023 inch (0.5842 mm) thick stainless VCR gasket on tank inlet 126 where the gasket has a 0.01 inch (0.254 mm) diameter hole.

To sense the level of the liquid in vapor tank 170, vapor delivery system 100 may utilize level sensor 176 comprising PCB 174 having one or more reed sensors and float 220 comprising a magnet, as will be detailed below. Before elaborating on specific embodiments of various components of vapor delivery system 100, however, it may be helpful to present a block diagram of an embodiment of vapor delivery system 100 to aid the reader in a greater understanding of such a system.

Figure 3:
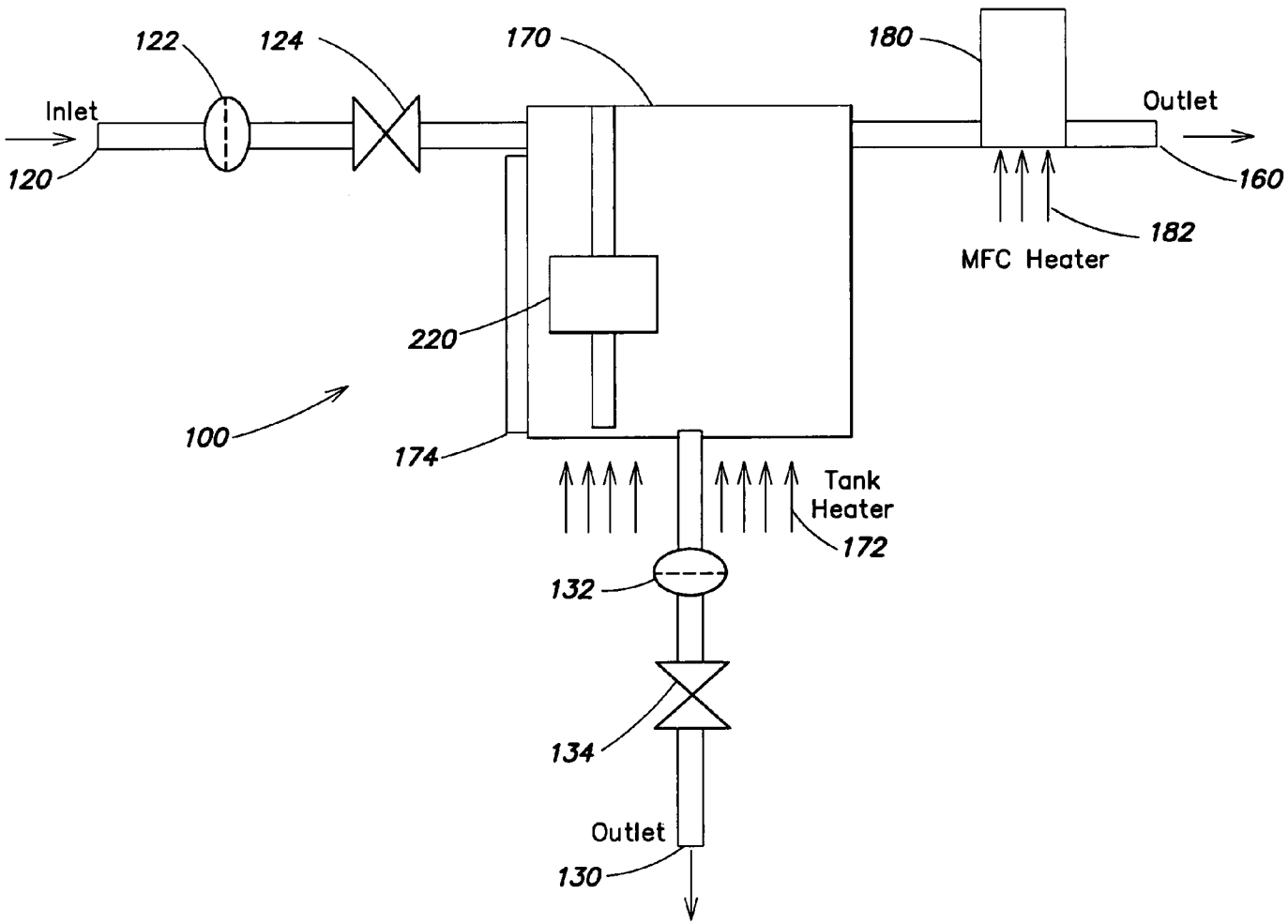
FIG. 3 is a diagrammatic representation of one embodiment of a vapor delivery system.

FIG. 3 presents just such a block diagram of an embodiment of vapor delivery system 100. Vaporizer tank 170 is coupled to a source of liquid de-ionized water through system inlet 120. Before entering vaporizer tank 170, the liquid water passes through filter 122 and fill valve 124 which is operable to control the flow of water to vaporizer tank 170. Filter 122 may serve to protect fill valve 124 from contaminants or particulate matter in the liquid and may comprise stainless steel wire mesh (e.g. 325×325×0.0014) with 0.0017 inch× 0.0017 inch holes and of 0.3 inch diameter welded into the tube fittings. Filters of this type may be field replaceable for added convenience. Fill valve 124 itself may comprise a Teflon wetted surface and be rated for around 20 million cycles and may be, for example, a Bio-chem Valve Inc., 075T series having a CV of 0.013 (e.g. Bio-chem MFG P/N 075T2-S126x).

In one embodiment, level sensor 176 comprises float 220 having a magnet which, when used in conjunction with PCB 174 having one or more reed sensors, is operable to sense the level of a liquid in vaporizer tank 170. The liquid in vaporizer tank 170 may be heated indirectly through one or more tank heaters 172 which are coupled to vaporizer tank 170. When liquid within vaporizer tank 170 is heated vapor may be produced. The flow of this vapor out of vapor outlet 160 may be controlled through the use of a mass flow controller 180, for example a temperature based mass flow controller such as a Tylan thermal-based VC4900 series mass flow controller.

To ensure that condensation does not form from vapor flowing from vaporizer tank 170 and through vapor outlet 160, mass flow controller 180, outlet plumbing coupling vaporizer tank 170 to mass flow controller 180, and outlet plumbing coupling mass flow controller 180 to vapor outlet 160, may be kept at a temperature slightly higher than the temperature of vaporizer tank 170 (e.g. between 5° and 15° C. hotter than vaporizer tank 170). The heating of mass flow controller 180 and the associated output plumbing may be accomplished through the use of one or more mass flow controller heaters 182 coupled to the mass flow controller 180.

Over time metallic ions which leach into the water and other contaminants may accumulate such that the vapor being delivered by the system is unacceptably contaminated. In this case it may be desirable to drain vaporizer tank 170 in order that contaminated water may be removed. To this end, vaporizer tank 170 is coupled to drain outlet 130. Liquid may flow from vaporizer tank 170 through filter 132 (which may be similar to the filters discussed above with respect to filter 122) and drain valve 134 which is operable to control the flow of water from vaporizer tank 170. In one embodiment, drain valve 134 may be. a Bio-chem Valve Inc., 075T series having a CV of 0.0305 (e.g. Bio-chem MFG P/N 075T2-S126x).

Figure 4A:
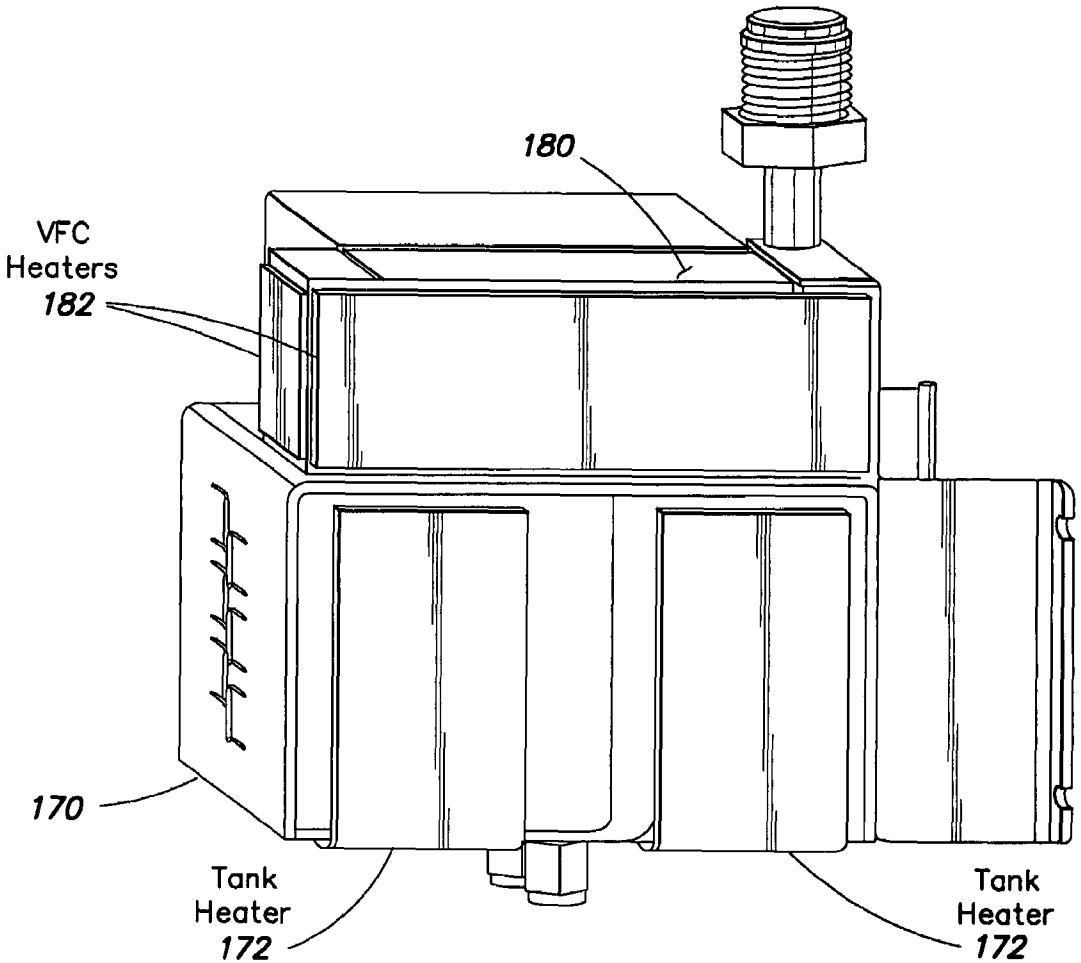
FIG. 4A is a diagrammatic representation of a view of an embodiment of a vaporizer tank, a mass flow controller and heaters.
Figure 4B:
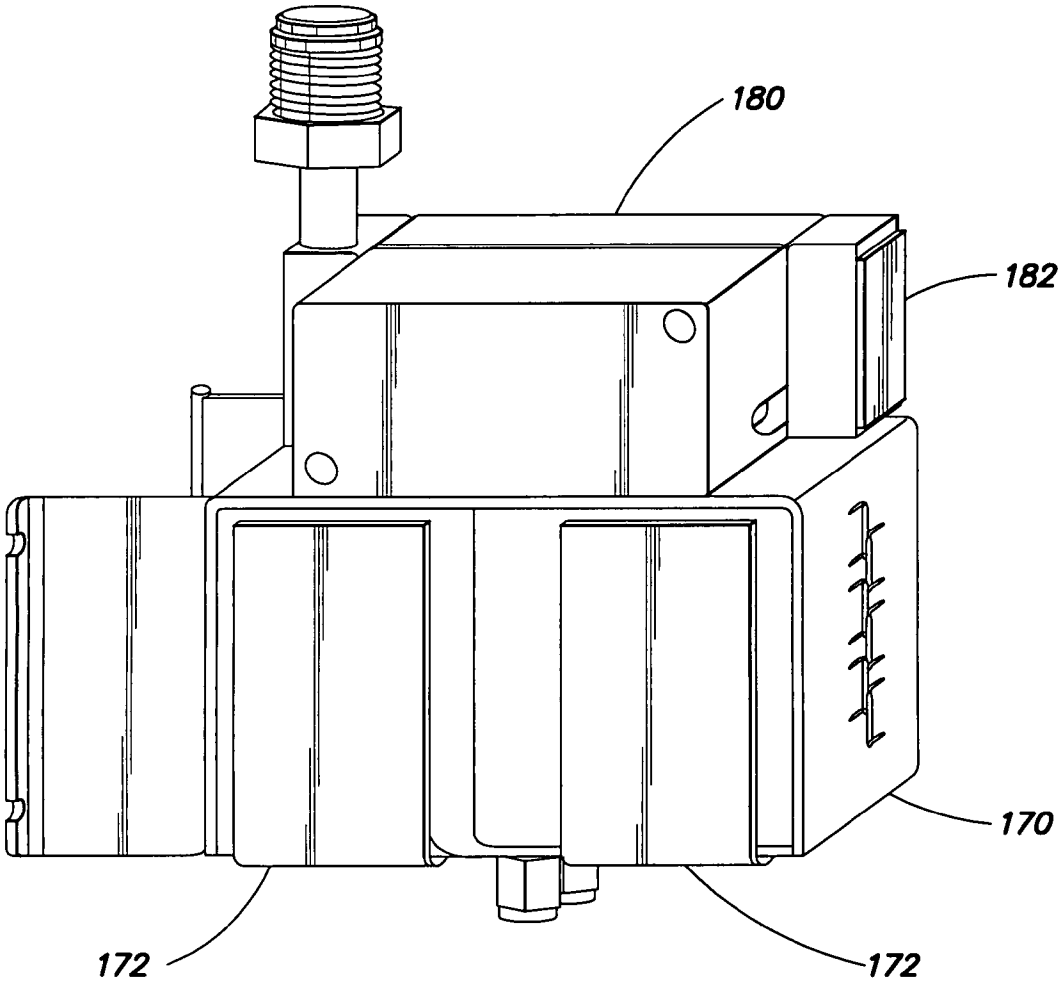
FIG. 4B is a diagrammatic representation of a view of an embodiment of a vaporizer tank, a mass flow controller and heaters.

Now that a general overview of vapor delivery system 100 has been given, it may be useful to describe in more detail embodiments of various components which may be utilized in conjunction with embodiments of vapor delivery system 100. FIGS. 4A and 4B depict two views of embodiments of a vaporizer tank, a mass flow controller and their respective heaters. More specifically, mass flow controller 180 may have two heaters 182 operable to heat mass flow controller 180 and, in some embodiments, output plumbing which couples vaporizer tank 170 to mass flow controller 180 or mass flow controller to vapor outlet 160. Each heater 182 may physically contact one or more surfaces of mass flow controller 180. Vaporizer tank 170 may itself have two heaters 172. Heaters 172 may physically contact vaporizer tank 170 around three surfaces of vaporizer tank 170. Each of heaters 172, 182 may be a silicon tape heater, as is known in the art.

In one embodiment, heaters 172, 182 may comprise a dual-zone heating system. Heaters 182 on mass flow controller 180 may utilize direct current (DC) power and comprise one heating zone while heaters 172 on vaporizer tank 170 may utilize alternating current (AC) power and form another heating zone. By utilizing dual AC heaters 172 on vaporizer tank 170, vapor delivery system 100 may operate using, for example, either 110 VAC or 220 VAC by configuring heaters 172 in series or in parallel appropriately based on the voltage utilized, so that the overall heat output of heaters 172 is substantially identical no matter the voltage. In some cases heaters 172 may be configured in parallel or series using jumpers or a fuse assembly residing on power supply circuitry on PCB 190.

In operation, each set of heaters 172, 182 may be controlled by a Proportional Integral Derivative (PID) controller loop, such that heaters 172 comprising one heating zone are controlled by one PID control loop and heaters 182 comprising the other heating zone controlled by another PID control loop. Each of these control loops may receive a setpoint and control its respective heaters 172, 182 based on a sensed temperature associated with the vaporizer tank 170 or mass flow controller 180, respectively. The temperatures associated with vaporizer tank 170 and mass flow controller 180 may be sensed by a temperature sensor (e.g., a resistive thermal device (RTD)). For example, the temperature sensor for the heating zone comprising heaters 172 may be located near, or between, tank inlet 126 and drain outlet 136, while the temperature sensor for the heating zone comprising heaters 182 may be located at or near a thermal sensor of a thermal based mass flow controller comprised by mass flow controller 180.

As mass flow controller 180 may be mounted on, in close proximity, or physically coupled to, vaporizer tank 170, the heaters 182 on mass flow controller 180 may receive a "boost" from heaters 172 on vaporizer tank 170, (e.g., heaters 172 may also provide some heat to mass flow controller 180). Consequently, heaters 182 may have to consume less energy to reach a setpoint or to maintain a setpoint, thus increasing the efficiency of vapor delivery system 100. Additionally, this "boost" may allow heaters 182 to reach a setpoint more quickly. The presence of an integrator in the control loops utilized with both of the heating zones, coupled with what may be the inherently slow nature of the system with which heaters 172 and 182 are being utilized, substantially alleviates crosstalk issues between each of the two heating zones.

Figure 5:
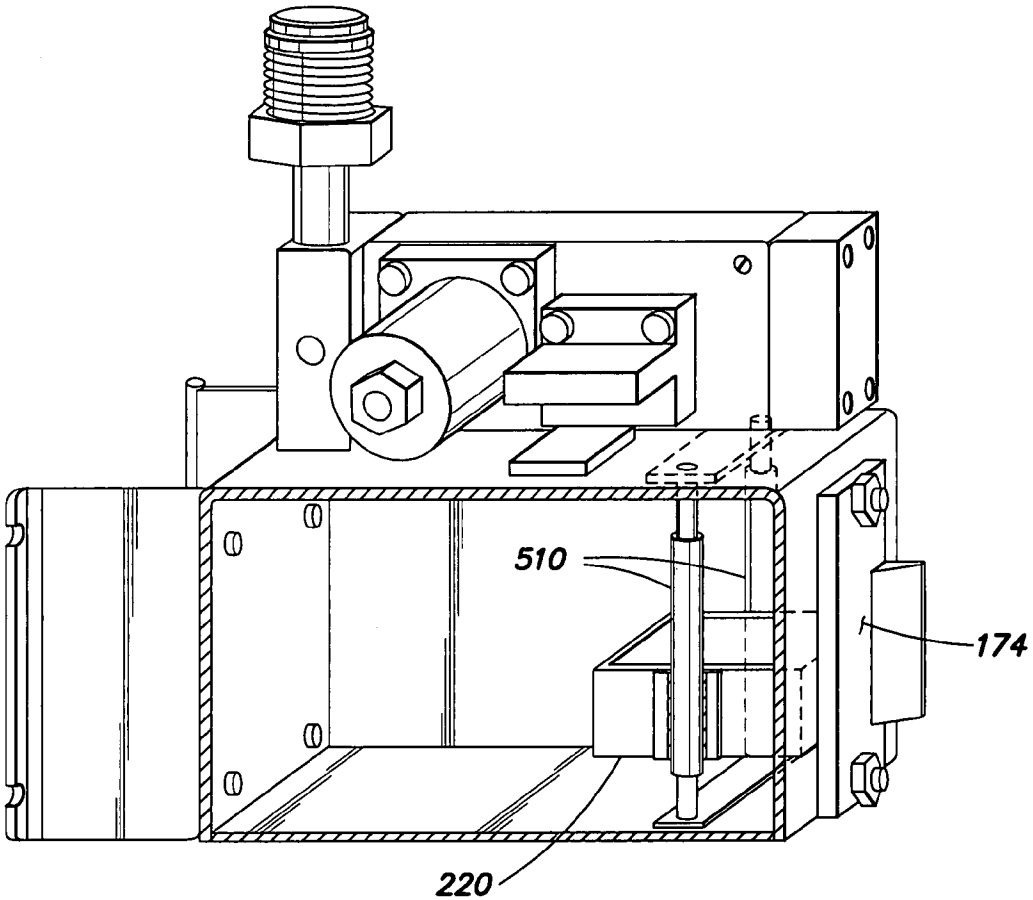
FIG. 5 is a diagrammatic representation of one embodiment of a vaporizer tank with an embodiment of a level sensor.

We now turn to embodiments of liquid level sensor 176 for use with embodiments of vapor delivery system 100. FIG. 5 depicts a cutaway view of vaporizer tank 170 with a sensor operable to provide substantially continuous water level detection. Float 220 may comprise a magnet such that when the float moves on Teflon coated titanium shafts 510 this movement may be sensed by one or more reed sensors on PCB 174 of level sensor 176.

Figure 6:
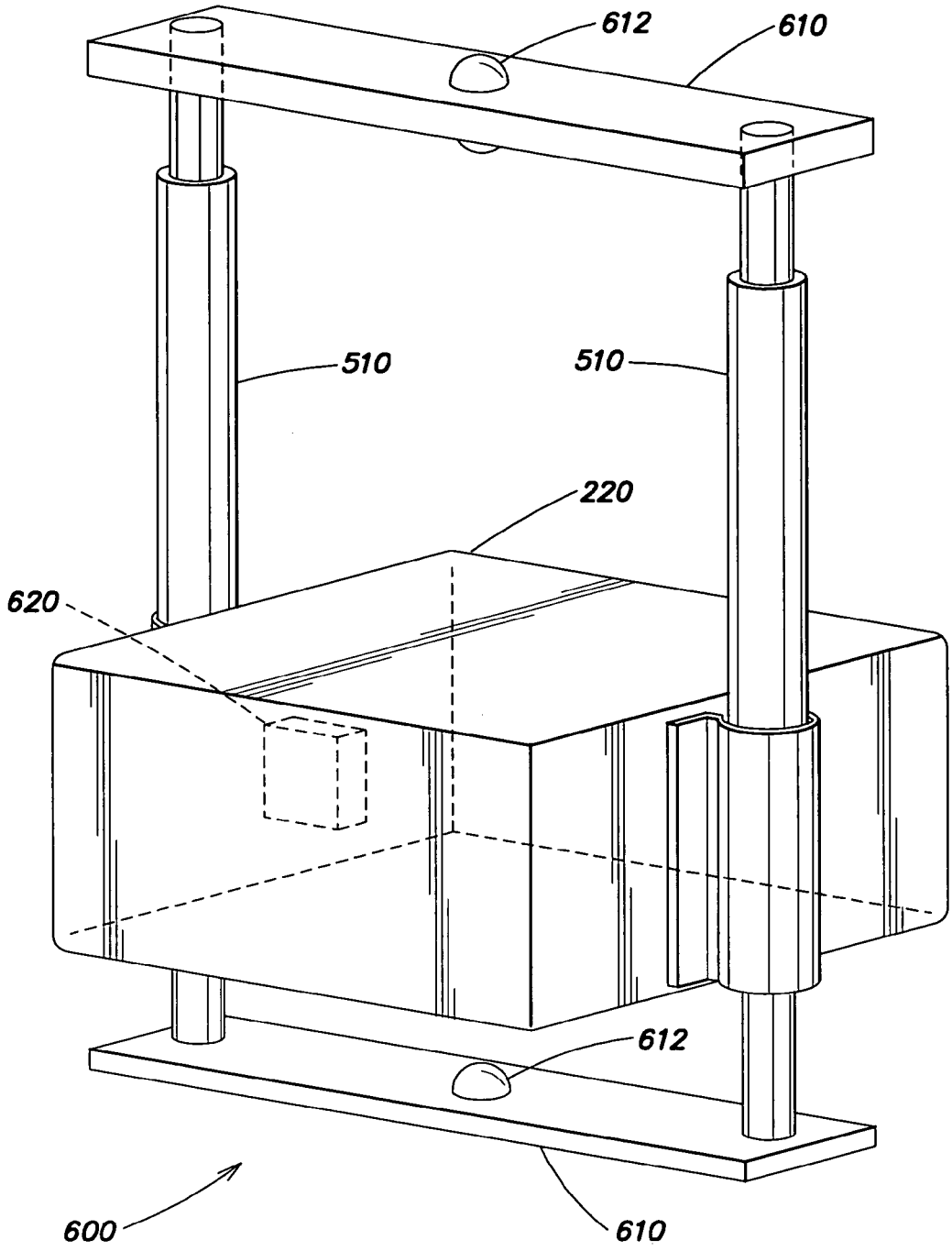
FIG. 6 is a diagrammatic representation of one embodiment of a float device for use with a level sensor.

A more detailed view of an example of a float device for use with an embodiment of a level sensor is depicted in FIG. 6. Float device 600 comprises float 220, plates 610 and shafts 510. Float 220 may be titanium and constructed such that it floats in liquid with approximately 65% of float 220 in the liquid and 35% of float 220 above the liquid when the liquid is water. Float 220 contains one or more magnets 620, which may be a McMaster-Carr P/N 5715K32, and is coupled to shafts 510 using Teflon coated couplings such that float 220 may slide on shafts 510. Float device 600 may be mounted in vaporizer tank 170 using plates 610. Plate 610 may have protrusion or dimples 612 to prevent the sticking of float 220 due to surface tension created by liquid in vaporizer tank 170. In one embodiment, these dimples 612 may be approximately 0.05 inches high.

Float 220, and hence magnet 620, rises and falls with the level of liquid in vaporizer tank 170. This movement may be detected by reed switches on PCB 174 of level sensor 176.

Figure 7:
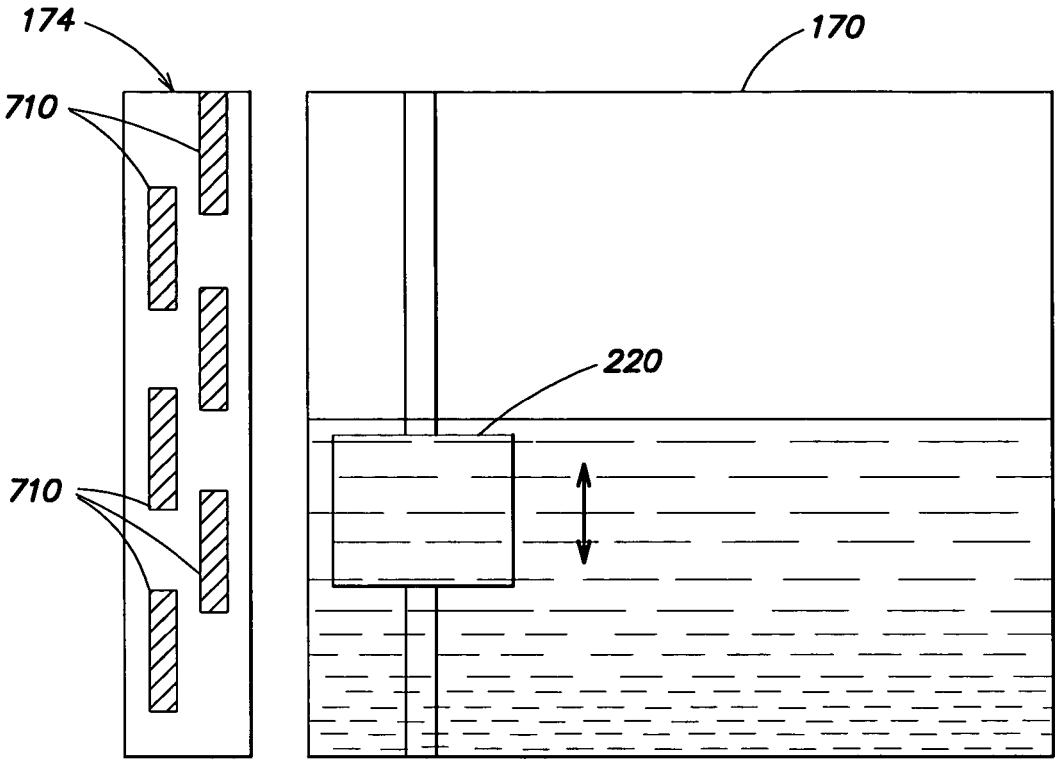
FIG. 7 is a diagrammatic representation of one embodiment of a level sensor.
Figure 8A:
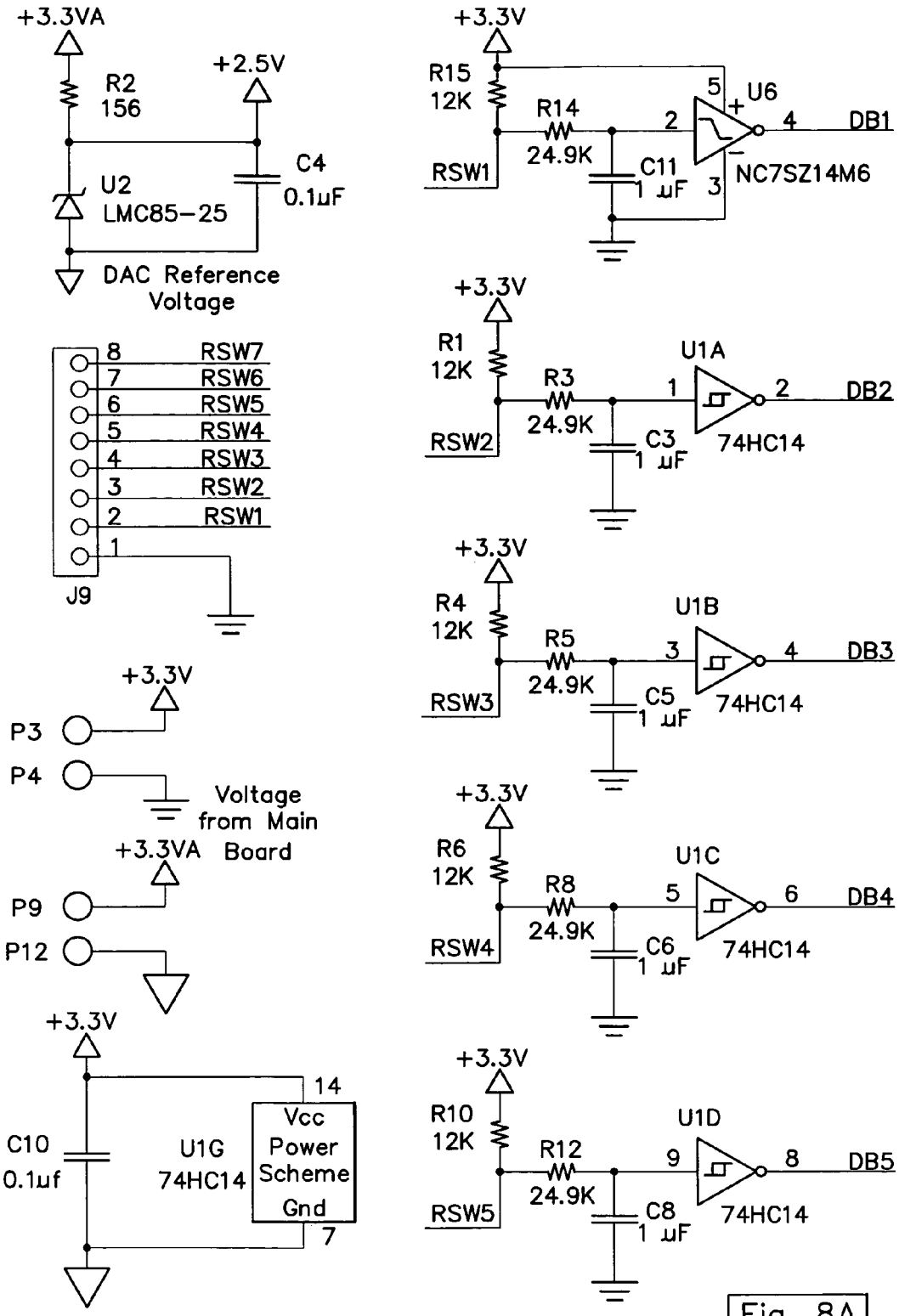
FIGS. 8A and 8B are a diagrammatic representation of a circuit for use with one embodiment of a level sensor.
Figure 8B:
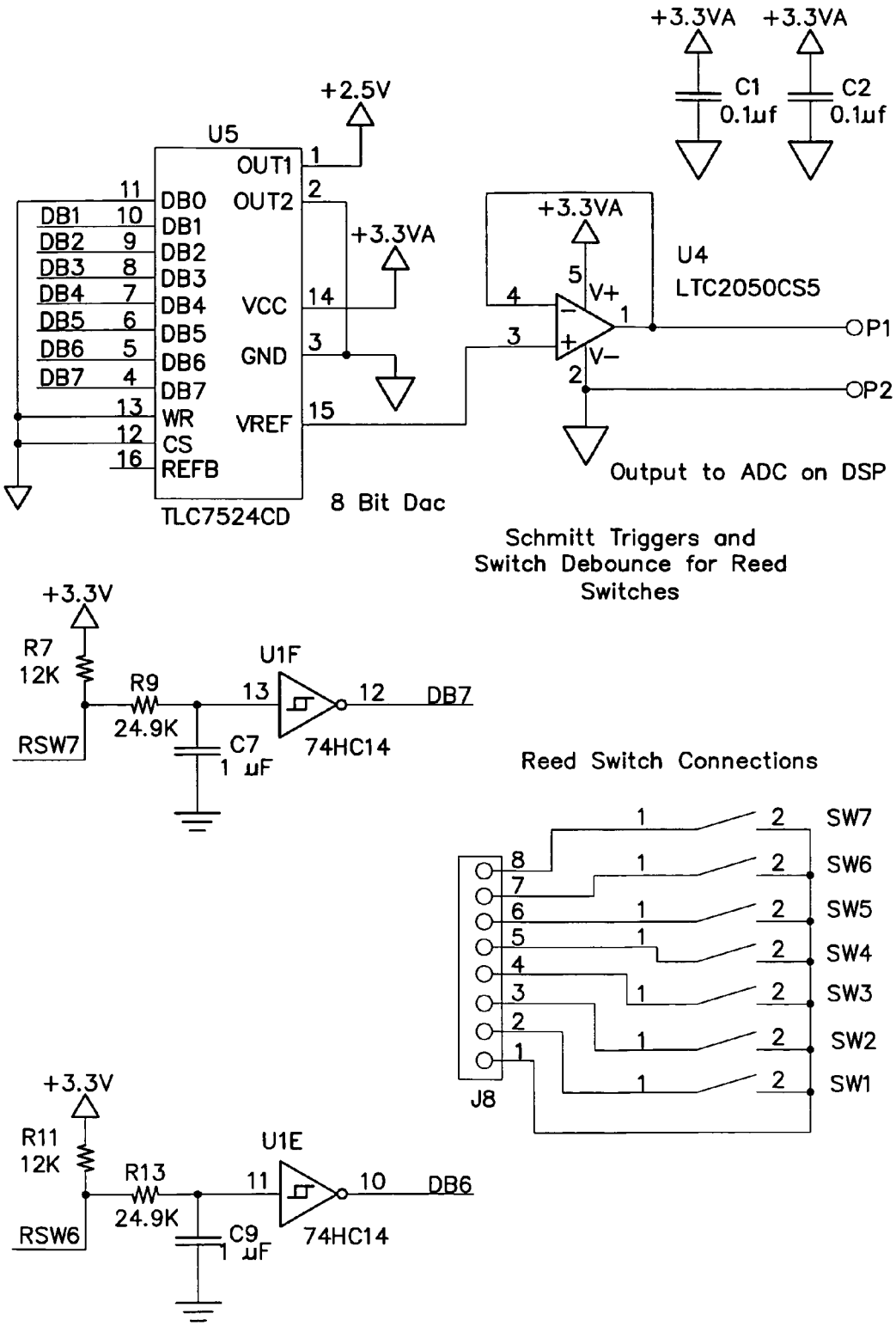

FIG. 7 is a diagram that depicts more clearly the operation of one embodiment of level sensor 176. Float 220 moves according to the level of liquid in vaporizer tank 170. PCB 174 comprises reed switches 710 such as Coto Technologies RI-80 SMD Series reed switches. In one embodiment, PCB 174 has five pairs of overlapping reed switches 710. Each pair of reed switches 710 has two switches for redundancy. In one configuration the detecting range of each reed switch is about +/−0.25 inches (6.35 mm) (e.g., up or down) while the spacing between every pair of reed switches 710 is approximately 0.375 inches (9.525 mm) to ensure there is overlap in coverage of magnet 620 of float 220. It will be apparent that more or fewer reed switches may be utilized if desired, and that embodiments of the level sensor 176 such as those depicted in FIG. 7 may continuously sense the level of liquid in vaporizer tank 170. FIGS. 8A and 8B depict a circuit diagram for one embodiment of a circuit which can be utilized in conjunction with reed switches 710 on one embodiment of PCB 174.

While embodiments of the present invention may use a set of reed switches 710 along with magnetic float 220 to sense the level of liquid in vaporizer tank 170, other methods of level sensing may also be utilized, where these methods may be point of use or continuous. For example, ultrasonic sensors may be utilized to monitor a liquid level by determining the time it takes an ultrasonic pulse to travel a certain distance. Additionally, one or more optical switches such as those of the Honeywell LLE series may be utilized.

Figure 9A:
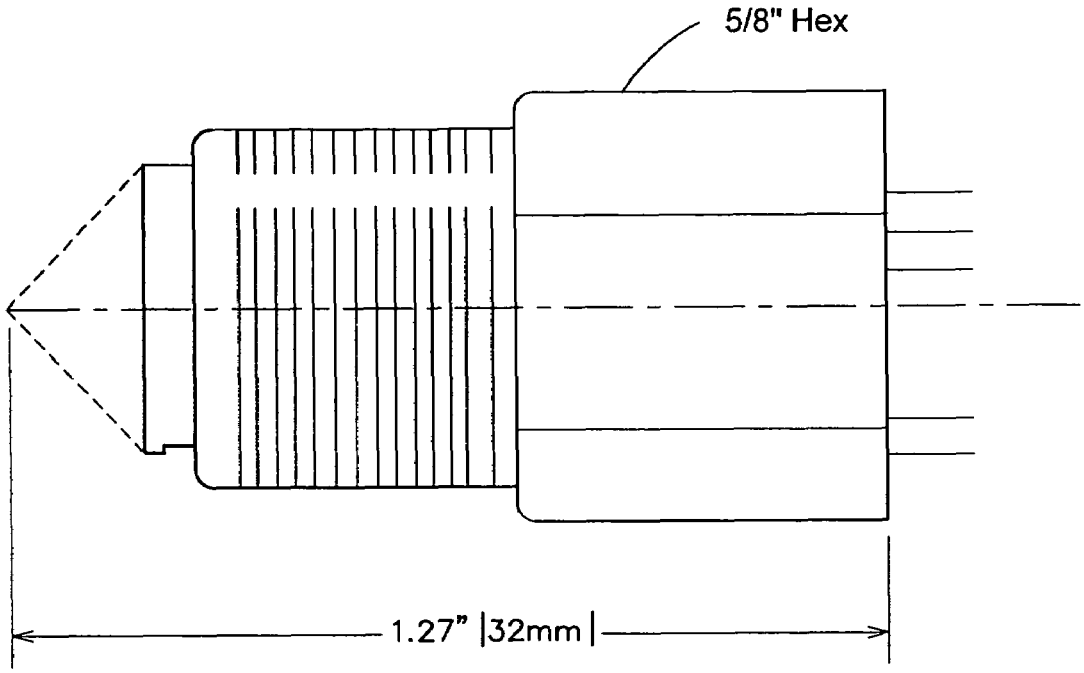
FIG. 9A is a diagrammatic representation of one embodiment of an optical level sensor.

FIG. 9A depicts one example of an optical level sensor for use with embodiments of the present invention. When using optical level sensors one optical level may be used to sense each desired liquid level, for example one optical level sensor may be used to sense if liquid in vaporizer tank is at or above an operating level or below the operating level, while another optical level sensor may be used to sense if liquid in vaporizer tank is at or above an overfill level or below the overfill level etc. Redundant sensors may also be used to ensure operability of vapor delivery system 100 if one of these level sensors 176 fails. In many cases, because optical level switches may be sensitive to moisture or condensation on their lenses it may be desired to heat such optical level sensors to prevent condensation if such optical level switches are utilized.

It may occur to the reader that during the vaporization process occurring in vaporization tank 170, the liquid may be at or near boiling and the surface level of the liquid may be variable. Thus, it may be desirable to employ one or more techniques to stabilize the signal output of whatever type of level sensor is utilized with a particular embodiment of vapor delivery system 100. These techniques may include physical means. For example, the float utilized with reed switches may be coupled to two shafts and be heavy relative to the liquid with which it is being utilized which may somewhat temper the effects of varying liquid levels. Alternatively, the float for a reed switch may be contained in a vertically oriented tube with holes near the bottom so liquid may enter the tube, where the tube serves as a barrier against the movement of the liquid.

Figure 9B:
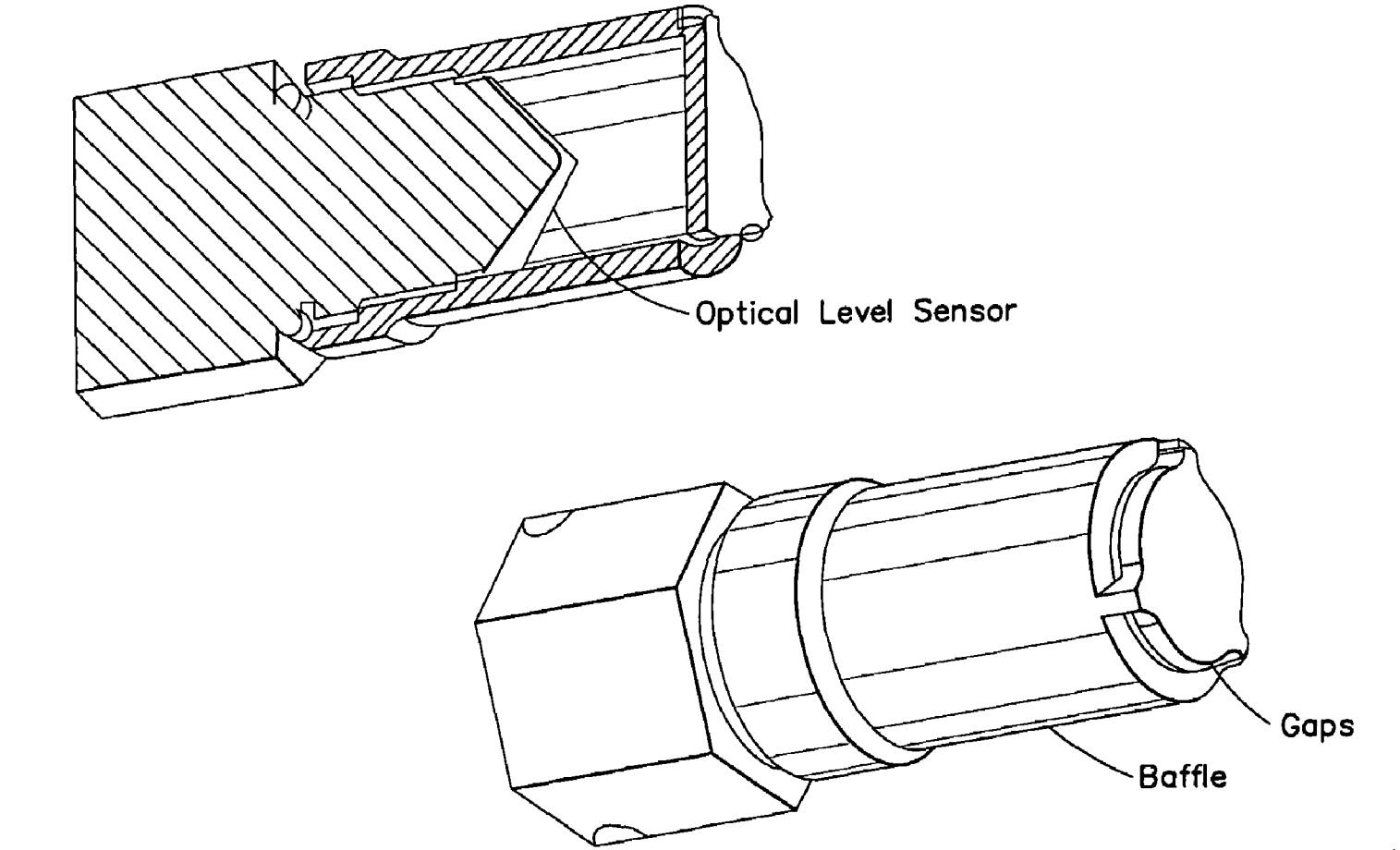
FIG. 9B is a diagrammatic representation of an embodiment of a baffle for use with an optical level sensor such as that of FIG. 9A.

Furthermore, if an optical level sensor is utilized, baffles may be attached to an optical sensors's sensing area to attenuate the effects of the varying liquid level, as depicted in FIG. 9B. Logical means, such as signal processing of the signal from the level sensor(s), may also be used to stabilize the output of level sensing devices, for example, hysterisis compensation or averaging techniques.

During operation of vapor delivery system 100, liquid in vaporizer tank 170 is heated to a substantially stable temperature using heaters 172. This temperature may be between 70° C. and 150° C. in general, between about 90° C. and 100° C. for water, and may be around 93° C. for water in many cases. When vaporizer tank 170 has reached this stable temperature (and thus, indirectly, liquid within vaporizer tank 170 has reached a substantially stable temperature) vapor within vaporizer tank 170 may be in a substantially saturated condition.

This temperature may then be substantially maintained using heaters 172 such that the saturated vapor conditions inside vaporizer tank 170 persists, resulting in a substantially fixed relationship of pressure and temperature inside vaporizer tank and providing substantially steady vapor pressure at mass flow controller 180 which, in turn, may regulate the flow of vapor from vaporizer tank 170 to downstream components.

Additionally, during operation of vapor delivery system 100, mass flow controller 180 may be maintained at a higher temperature than the desired stable temperature of vaporizer tank 170 to prevent re-condensation of vapor flowing through mass flow controller 180. Usually this temperature is 5° C. to 15° C. higher than the stable temperature of vaporizer tank 170. For example, when the vapor tank is to be maintained at around 93° C., heaters 182 may be set to maintain mass flow controller 180 at around 105° C.

Figure 10:
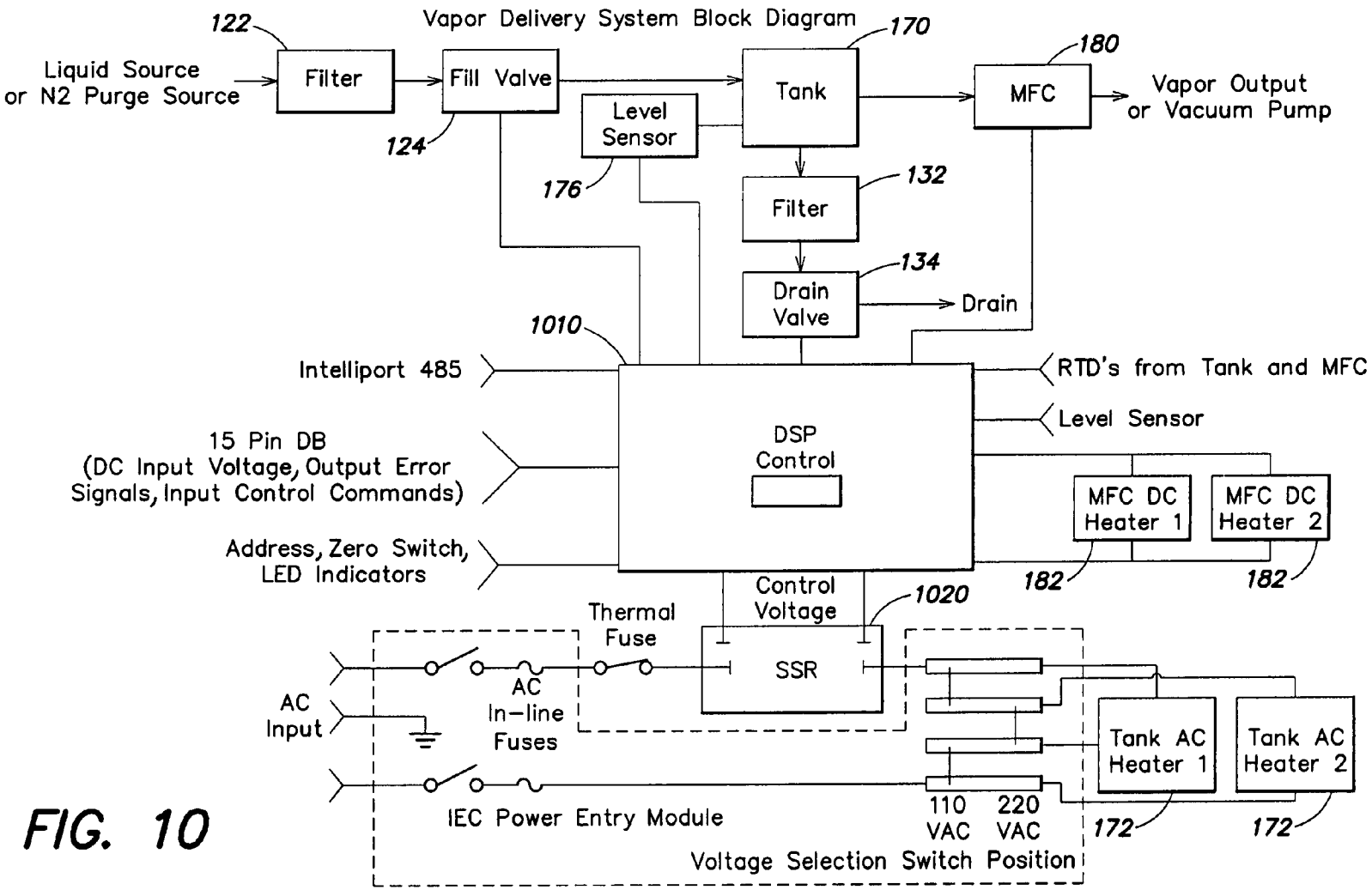
FIG. 10 is a diagrammatic representation of one embodiment of a vapor delivery system.

More detailed embodiments of the operation of embodiments of a vapor delivery system may be explained better with reference to FIG. 10 which depicts a block diagram of one embodiment of a vapor delivery system. Vapor delivery system 100 comprises inlet filter 122, fill valve 124, vaporizer tank 170, level sensor 176, drain filter 132, heaters 172 and 182, and digital signal processing (DSP) controller 1010 which may include hardware and/or instructions to control vapor delivery system or components of vapor delivery system 100. DSP controller 1010 may be operable to receive and send signals to control components of vapor delivery system 100 such as fill valve 126, level sensor 176, mass flow controller 180, drain valve 134, heaters 172, 182. DSP controller 1010 may also be operable to communicate with one or more other systems through interfaces such as an RS485, RS232, another type of electronic communication port, or the like.

DSP controller 1010 may comprise a processor, associated memory, and a set of executable instructions operable to control vapor delivery system or components of vapor delivery system 100 (e.g., Xicor Serial EEPROM P/N X5163S8-2.7A, Texas Instruments DSP Controller TMS320LF2407APGEA).

Figure 11:
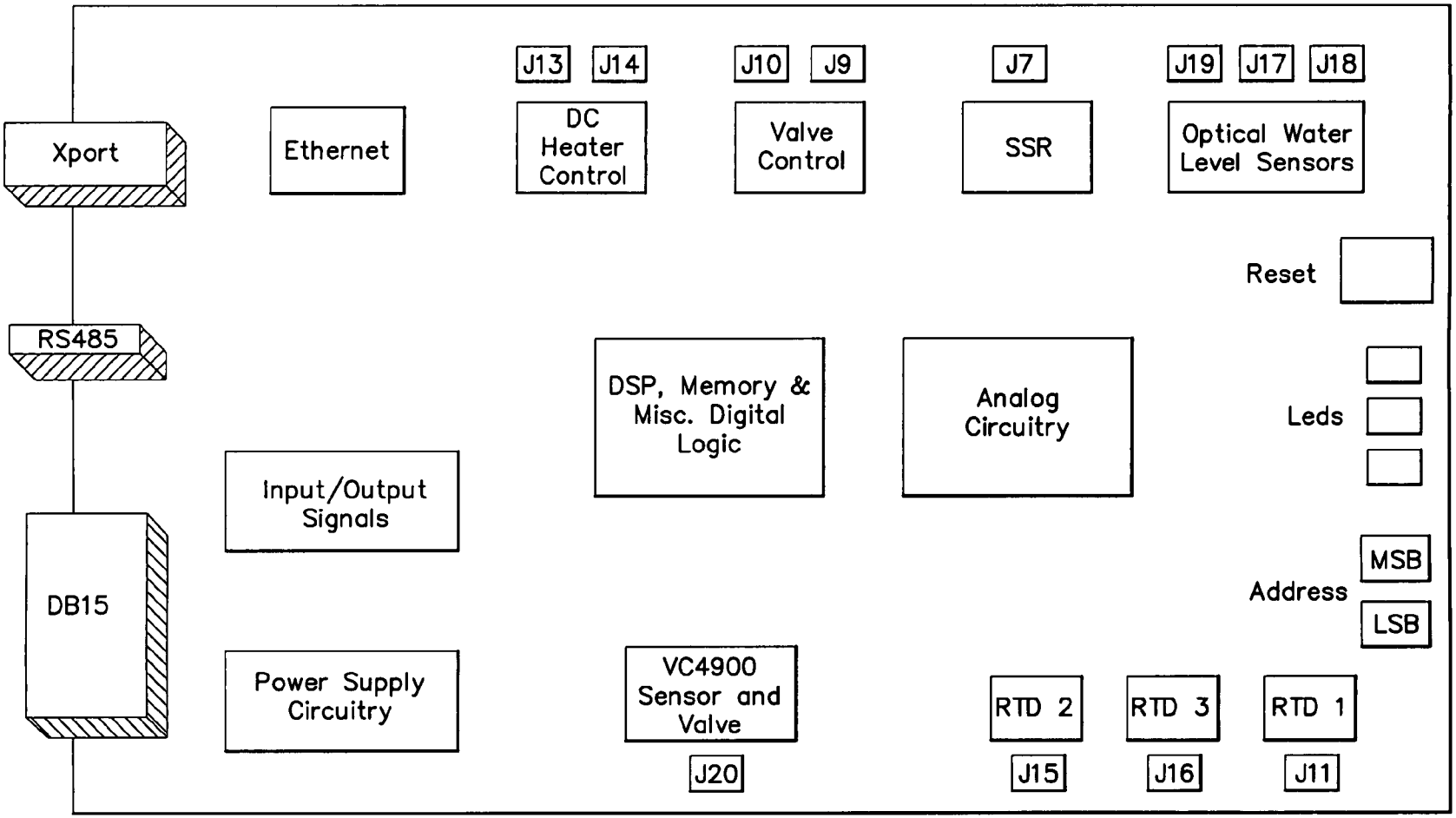
FIG. 11 is a diagrammatic representation of one embodiment of a PCB layout for use with embodiments of the present invention.

Instructions executed by DSP controller may comprise firmware operable for operating vapor delivery system 100, where this firmware may, in embodiments, be conceptually divided into three modules, a module for monitoring and maintaining a liquid level in vaporizer tank 170, a module for heating, including heating of vaporizer tank 170 to a setpoint to generate vapor and the heating of mass flow controller 180, and a module for the delivery of vapor at a setpoint. Firmware executing in conjunction with DSP controller 1010 may also record errors that occur during operation in the associated memory, such as an EEPROM or another data saving device within vapor delivery system 100. Each error detected by the firmware may have an error code. This error code may be stored in a circular buffer in an EEPROM along with a time stamp, such that locations in the buffer may be overwritten if a certain number of errors occur. In one embodiment, DSP controller 1010 may reside on PCB 190 along with associated electronic components for operating or controlling vapor delivery system. FIG. 11 depicts one embodiment of a PCB layout including an embodiment of the processor of a DSP controller.

Initially, during operation of vapor delivery system 100 in one embodiment, DSP controller 1010 may send a signal to close fill valve 124 and drain valve 134, after which vaporizer tank 170 may be pumped down by drawing a vacuum through at vapor outlet 160. This reduces the pressure in vaporizer tank 170 such that if vaporizer tank 170 is subsequently filled with liquid, such as de-jonized water, pressure in vaporizer tank 170 will not increase substantially as the vaporizer tank 170 is filled. Additionally, DSP controller 1010 may turn on heaters 182 to heat mass flow controller 180 to an operating temperature which may be around 5° C. to 15° C. higher than the operating temperature to be utilized in conjunction with vaporizer tank 170. In some embodiments, control of heaters 182 may be accomplished utilizing a PID control loop in the firmware operating on DSP controller and operable to control heaters 182, as detailed above.

After the initial pumpdown of vaporizer tank 170, DSP controller 1010 may send a signal to open fill valve 124 such that liquid is allowed to flow, and is admitted to, vaporizer tank 170. DSP controller 1010 may receive a signal from level sensor 176 indicating when the liquid in vaporizer tank 170 has reached an operating level and may then close fill valve 124. In some embodiments this operating or working level may be around 300 ml.

Alternatively, after it is determined that the liquid in vaporizer tank 170 has reached the working level, vaporizer tank 170 may continue to be filled for a certain amount of time. This time period may be predetermined or operator set, and may depend on the vapor flow rate desired, type of liquid etc. In some embodiments this time period may be around two minutes. During this time period fill valve 124 may be held open or fill valve may be "strobed" by DSP controller 1010 such that fill valve 124 is opened and closed at intervals, as will be described later. After this time period DSP controller 1010 may send a signal operable to close fill valve 124. Additionally, DSP controller 1010 may turn on heaters 172 to heat vaporizer tank 172 to an operating temperature, which, in the case of de-ionized water, may be around 93° C. The control of heaters 172 may be accomplished using a PID control loop operating in the firmware of DSP controller 1010, as elaborated on above.

Once the temperature of vapor tank 170 has stabilized (e.g. within +/−2° C. of an operating temperature for a certain amount of time), which may be determined using a signal from a temperature sensor associated with vaporizer tank 170, vapor delivery system 100 may be in a ready state for commencing vapor flow. In one embodiment, before a ready state for vapor delivery system 100 is reached it may also be determined if the operating temperature for mass flow controller 180 has been reached and is stable utilizing temperature sensor associated with mass flow controller 180.

Subsequent to vapor delivery system 100 reaching a ready state vapor may be flowed to components downstream of mass flow controller 180. DSP controller 1010 may receive a vapor flow setpoint (which may have been received at a prior point) and operate mass flow controller 180 such that a flow rate of vapor corresponding to the vapor flow setpoint is substantially achieved, or alternatively, may provide the flow rate setpoint to mass flow controller 180 such that mass flow controller 180 regulates vapor flow from vaporizer tank 170 to substantially achieve the desired vapor flow setpoint. Vapor delivery system 100, may, in some embodiments, be operable to deliver vapor at flow rates up to 6 SLM.

While vapor delivery system 100 is flowing vapor from vapor outlet 160, DSP controller 1010 may substantially maintain the operating temperatures of vaporizer tank 170 and mass flow controller 180. These operating temperatures may be maintained by controlling heaters 172 and 182 using their respective PID control loops, as discussed above. By substantially maintaining the temperature of vaporizer tank 170 (and thus the liquid in vaporizer tank 170) the saturated vapor condition in vaporizer tank 170 may be substantially maintained and the upstream pressure of vapor at mass flow controller 180 may be substantially steady, allowing vapor delivery system to deliver a substantially steady and consistent flow rate of vapor.

Figure 12:
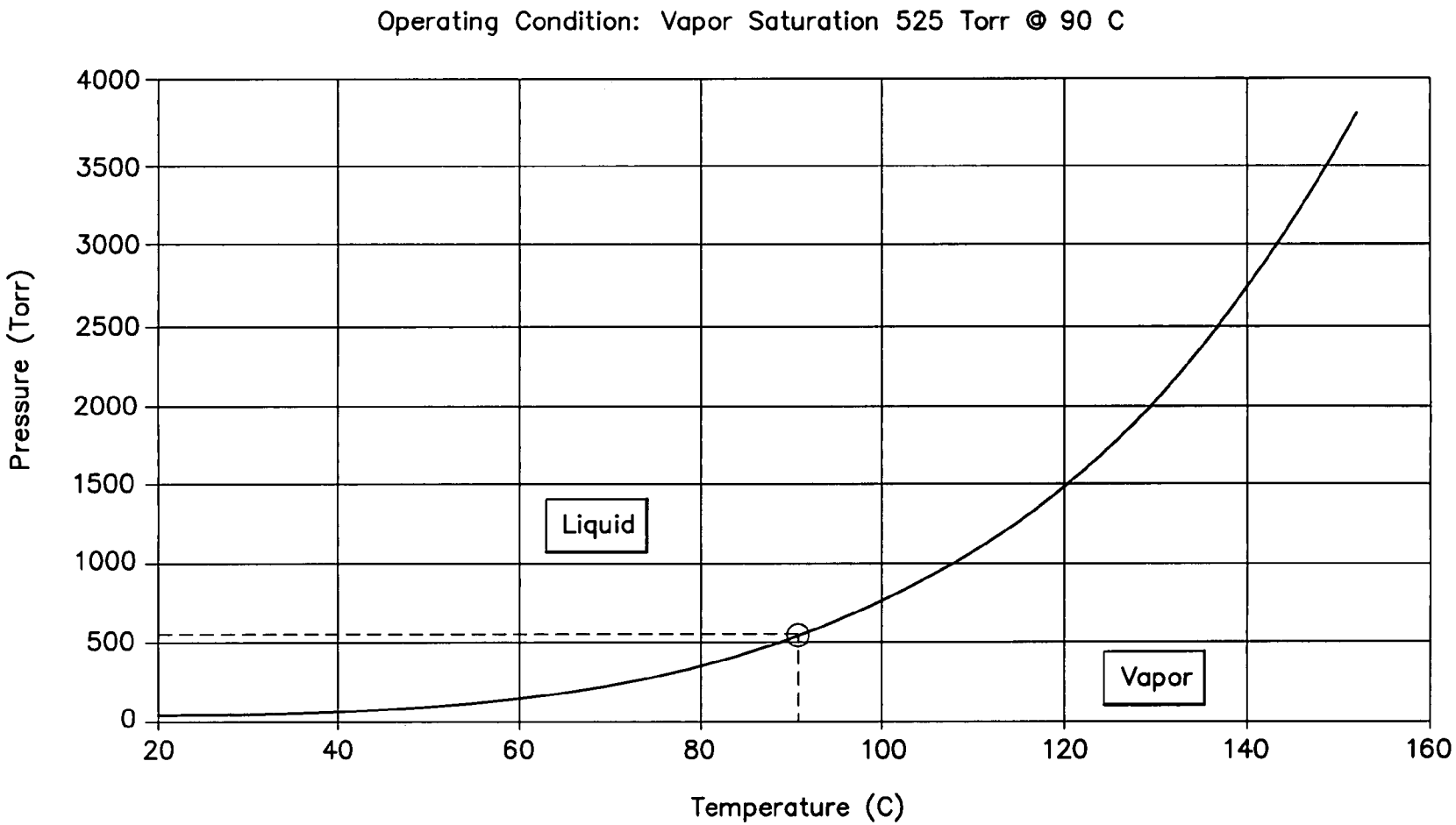
FIG. 12 is a diagrammatic representation of a pressure versus temperature curve depicting operating conditions for one embodiment of the present invention.

Briefly, one embodiment of a set of possible operating conditions for vapor delivery system 100 is depicted with respect to a pressure versus temperature curve in FIG. 12, where the temperature of the tank is approximately 90° C. and the pressure within vaporizer tank 170 is approximately 525 Torr. In the temperature range depicted operating at a vapor flow rate of approximately 3 SLM about 105 watts of heat may be consumed for heating vaporizer tank 170.

Returning to FIG. 10, during operation of vapor flow system 100 DSP controller 1010 may receive a signal from level sensor 176 that the level of liquid in vaporizer tank 170 has dropped below a minimum level, below the operating level or has exceeded a maximum level. DSP controller may then initiate certain actions based on these signals. For example, if DSP controller 1010 receives a signal from level sensor 176 indicating that liquid within vaporizer tank 170 has fallen below the minimum level or has risen above the overfill level, DSP controller may shut vapor delivery system 100 down for trouble shooting. In one embodiment, the minimum level for a 550 ml vaporizer tank 170 may be around 50 ml, while the overfill level for the same vaporizer tank 170 may be around 500 ml.

However, if DSP controller 1010 receives a signal from level sensor 174 that water has fallen below the operating level DSP controller 1010 may operate fill valve 124 to introduce liquid into vaporizer tank 170. In one embodiment, after receiving a signal from level sensor DSP controller 1010 may wait 5 to 10 seconds and verify that the signal from level sensor 176 still indicates that the liquid level in vaporizer tank 170 is below the operating level. After verifying that the signal from level sensor 176 indicates that the liquid level is below the operating level, DSP controller 1010 may operate fill valve 124 to achieve a certain fill rate during a refill period. This fill rate may be determined by several variables such as liquid source pressure, pressure drop from fittings and filters, the type and operation of fill valve 124, etc. In one embodiment, this fill rate may be twice the liquid consumption rate of vapor delivery system 100 utilized to produce vapor flow at full scale. For example, if approximately 2.5 ml per minute is flowing from vapor control system 100 the fill rate may be approximately 5 ml per minute.

This addition of liquid to vaporizer tank 170 may cause temperature and pressure fluctuations in the liquid in vaporizer tank 170. While the liquid present in vaporizer tank 170 may serve to dampen these temperature and pressure fluctuations somewhat, in order to further minimize these temperature fluctuations and pressure fluctuations, which may be exacerbated by differences in liquid source pressure, fill valve 124 may be gated, or the duty cycle of the fill valve controlled, to open and close the fill valve during the refill period to achieve a desired fill rate during the refill period. By minimizing disturbance to the state of vaporizer tank 170 while adding liquid to vaporizer tank 170 a substantially steady flow rate of vapor may be maintained while the addition of liquid is occurring.

Figure 13:
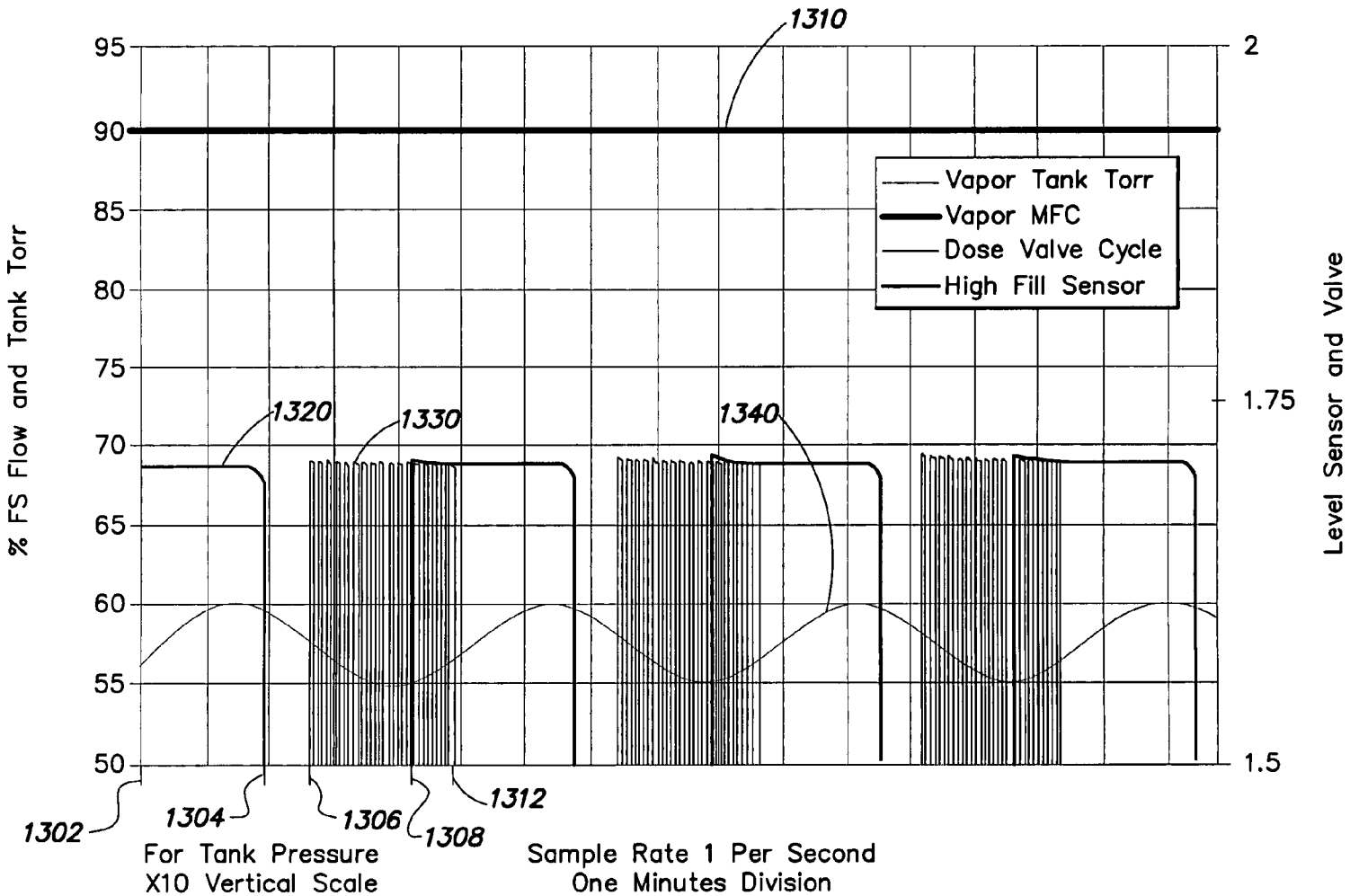
FIG. 13 is a graph depicting signals and states occurring during operation of one embodiment of the present invention.

This advantage may be better illustrated with reference to FIG. 13, which is a graph depicting signals and states which may occur during one embodiment of liquid addition to vaporizer tank 170 during operation of vapor flow system 100. More particularly, line 1310 represents the vapor flowing from mass flow controller 180 as a percentage of full scale (FS) of one embodiment of vapor control system 100 (which in this example is 3 SLM), line 1320 represents a signal from level sensor 176 indicating the level of liquid in vaporizer tank 170 with respect to the operating level, line 1330 represents the signal provided to fill valve and line 1340 represents the pressure in vaporizer tank 170.

At time 1302, notice that the line 1310 indicates that the vapor flow rate is approximately 90% of FS. At time 1304, then, signal 1320 goes low, indicating that the level of liquid in vaporizer tank 170 has dropped below the operating level. After a pause of approximately 30 seconds, at time 1306 signal 1330 oscillates indicating that fill valve 124 is being opened and closed to achieve the desired fill rate, until at time 1308 signal 1320 goes high, indicating that the liquid in vaporizer tank 170 has again reached the operating level. Signal 1330 indicates, however, that fill valve continues to be cycled for an amount of time after signal 1320 indicates that the operating level has been reached. In the embodiment depicted, fill valve 124 may be cycled for approximately 30 seconds before, as indicated by signal 1320, it is closed around time 1312. In other embodiments, the refill period may continue for approximately 2-5 minutes after level sensor 176 signals that the liquid in vaporizer tank 170 has reached the operating level.

Notice that during the time between time periods 1302 and 1312 when liquid is being added to vapor tank 170 the flow of vapor from vapor delivery system 100 (indicated by signal 1310) remains substantially steady. Notice, as well, that between time periods 1302 and 1312 (and during the other points of operation depicted in FIG. 13) the pressure within vaporizer tank 170 varies no more than approximately 50 Torr.

In addition to oscillating fill valve 124 to refill vaporizer tank 170, in one embodiment, to combat the effect of the addition of liquid to vaporizer tank 170, DSP controller 1010 may signal heaters 172 to provide a heater kick for a certain time period during the refill process. For example, temperature of vaporizer tank 170 may be elevated to a predetermined temperature, to add more heat to substantially maintain a vapor saturation in the vaporizer tank 170 in order that the temperature of vaporizer tank may substantially return to the first setpoint once fill valve 124 has stopped pulsing opened and closed.

Returning to FIG. 10, to further immunize vapor delivery system 100 against liquid source pressure variations or to detect problems with liquid source flow, such as clogs etc. in one embodiment DSP controller 1010 may record the initial position of level sensor 176 at the start of the fill process and the time taken from the start of the fill process until level sensor 176 indicates that the operating level has been reached. Using this data the flow rate of liquid into vaporizer tank 170 may be calculated and compared with an expected liquid flow rate (or range) and an alarm given if the calculated liquid flow rate falls outside this range.

Even if the flow from a liquid source is cutoff or otherwise impaired, however, vapor flow system 100 may still continue delivering vapor at a set flow rate after the liquid level in vaporizer tank 170 falls below the operating level. For example, if vaporizer tank 170 is 2.5 inches×3.5 inches×4.0 inches after the liquid level drops below an operating level of about 330 ml vapor delivery system may continue to deliver vapor at about a 3 SLM flow rate for approximately two hours.

Occasionally, it may be desired to purge vaporizer tank 170 of water to eliminate built up contaminants, or for a wide variety of other reasons. This purge cycle may be initiated from a signal provided to DSP controller 1010 by an external controller, or by DSP controller 1010 after a certain number of uses of vapor delivery system 100, etc. DSP controller 1010 may operate heaters 182 of mass flow controller device 180 according to a setpoint and substantially close mass flow controller 180. DSP controller 1010 may signal both fill valve 124 and drain valve 134 to open and nitrogen gas may then be flowed in through fill valve 124 and utilized to purge vaporizer tank 170 by forcing contents of vaporizer tank 170 through drain valve 134. Nitrogen may be flowed for a predetermined amount of time to ensure that vaporizer tank 170 is properly purged.

While various advantages of the operation of embodiments of the present invention have been described, it may be helpful to depict the conditions during operation of embodiments of the present invention graphically so that advantages accruing to various embodiments of the present invention may be better appreciated. To this end FIGS. 14-19 depict various graphs of conditions occurring during operation of embodiments of the present invention.

Figure 14:
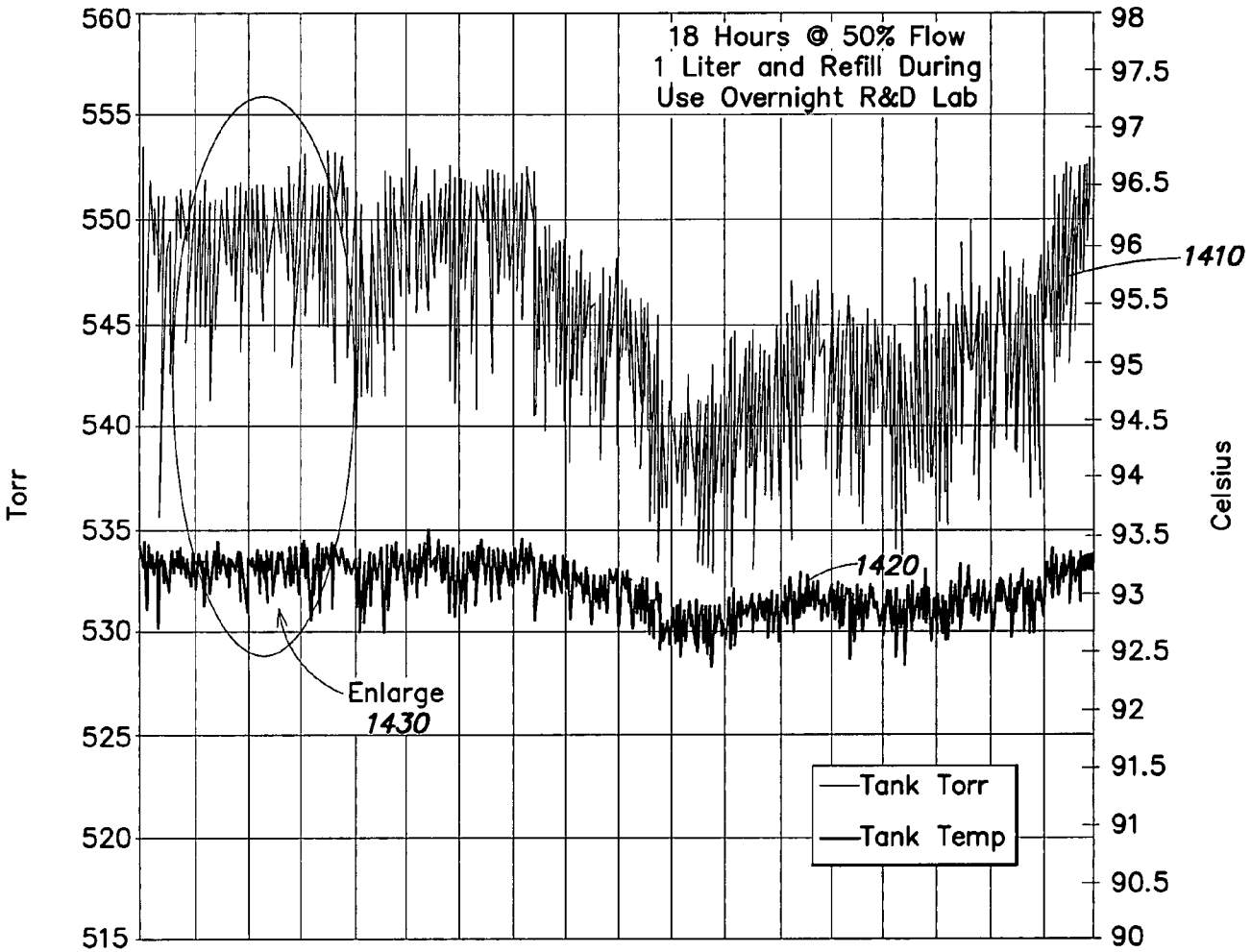
FIG. 14-19 are graphs depicting conditions occurring during operation of various embodiments of the present invention.

More particularly, FIG. 14 depicts the conditions associated with vaporizer tank 170 utilizing one embodiment of the present invention in an 18 hour time period. Line 1410 depicts the pressure in vaporizer tank 170 in Torr during this time period while line 1420 represents the temperature of vaporizer tank 170 during the time period.

Figure 15:
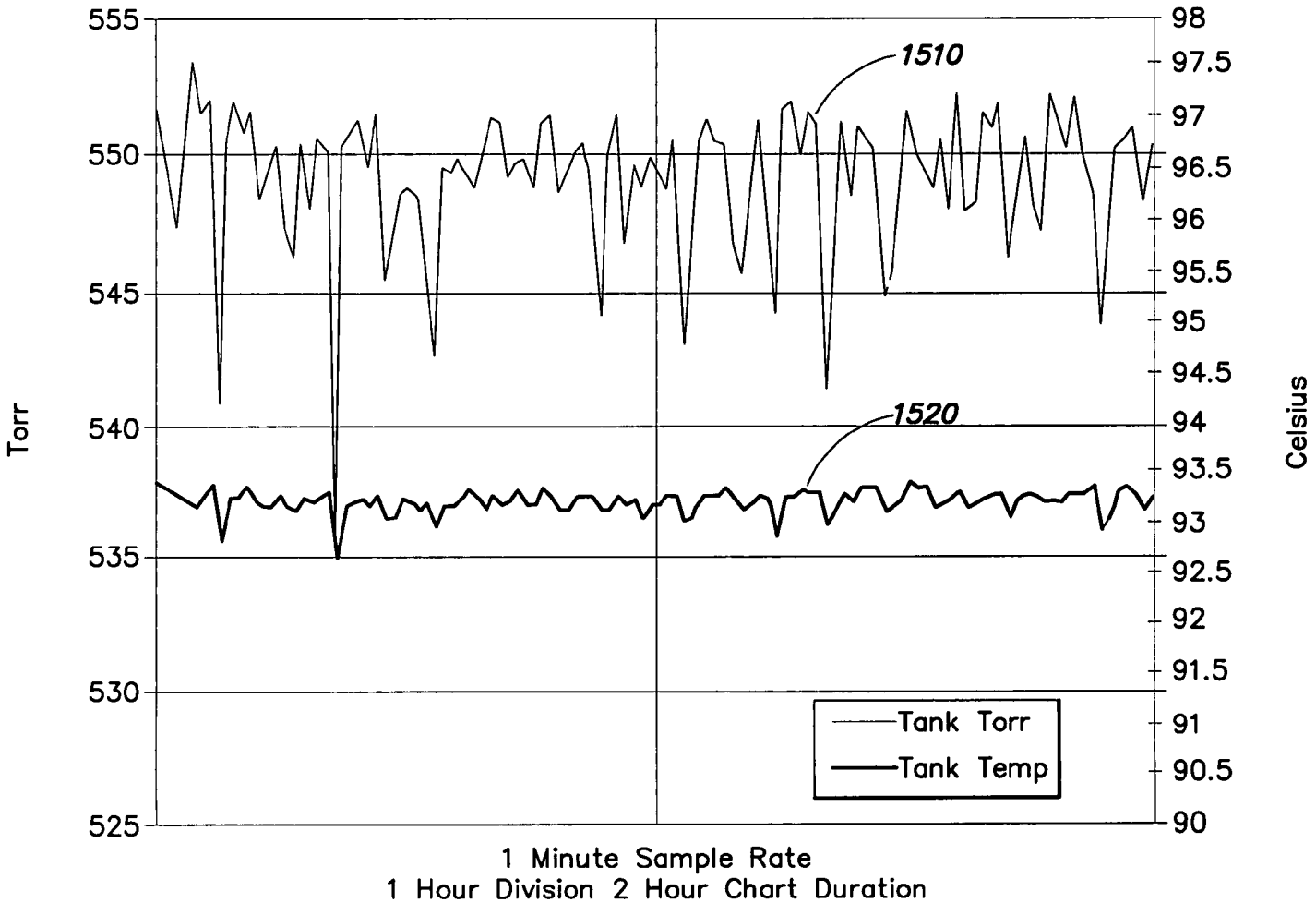

Area 1430 of FIG. 14 is enlarged and shown in FIG. 15 which depicts two hours of operation of one embodiment of the present invention, where once again line 1510 depicts the pressure in vaporizer tank 170 in Torr during this time period while line 1520 represents the temperature of vaporizer tank 170 during this time period.

Figure 16:
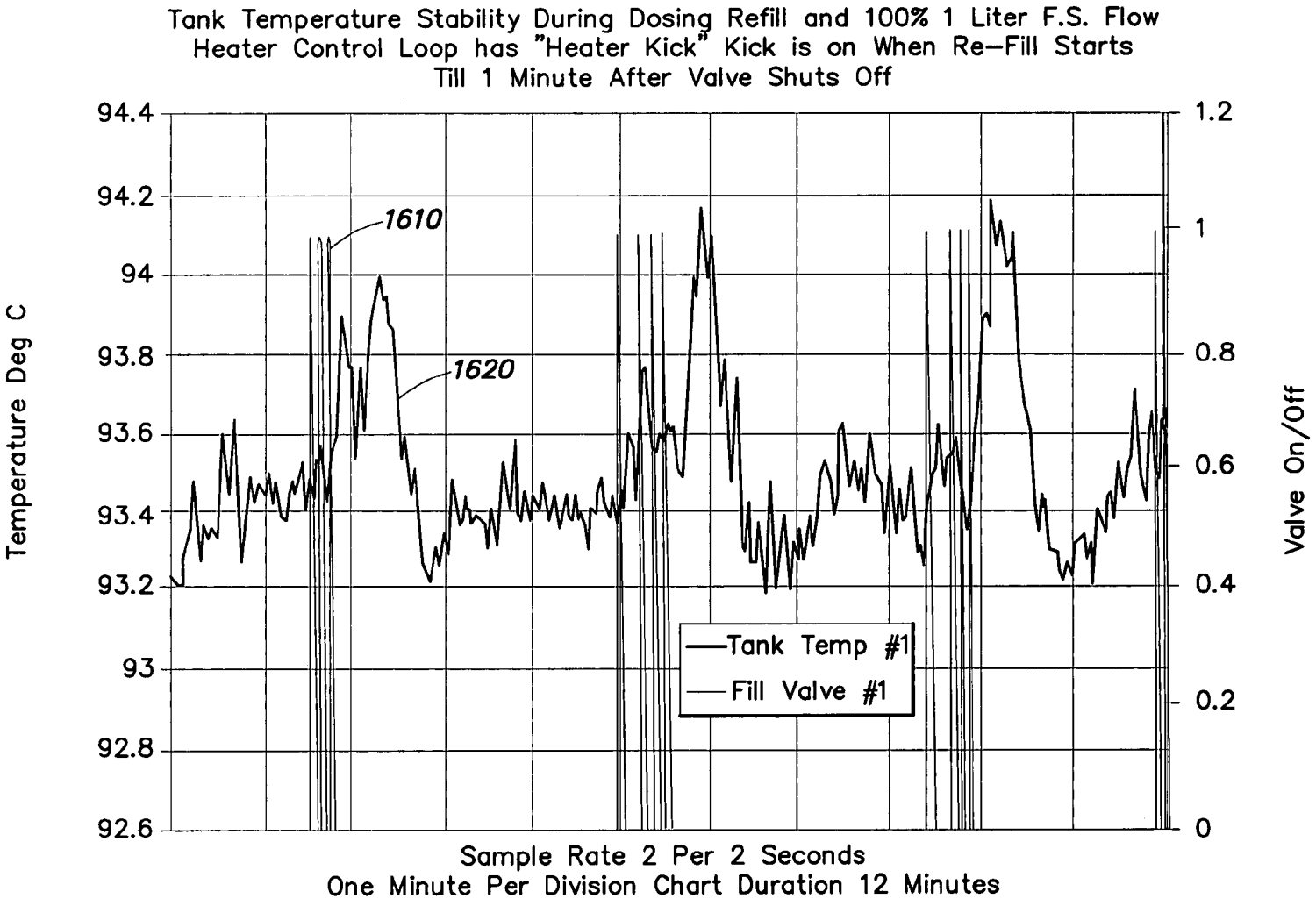

FIG. 16 is a graph depicting the stability of the temperature of vaporizer tank 170 during one or more refill periods occurring during operation of one embodiment of the present invention. In FIG. 16 line 1610 represents the state of fill valve 124, and line 1620 represents the temperature of vaporizer tank 170.

Figure 17:
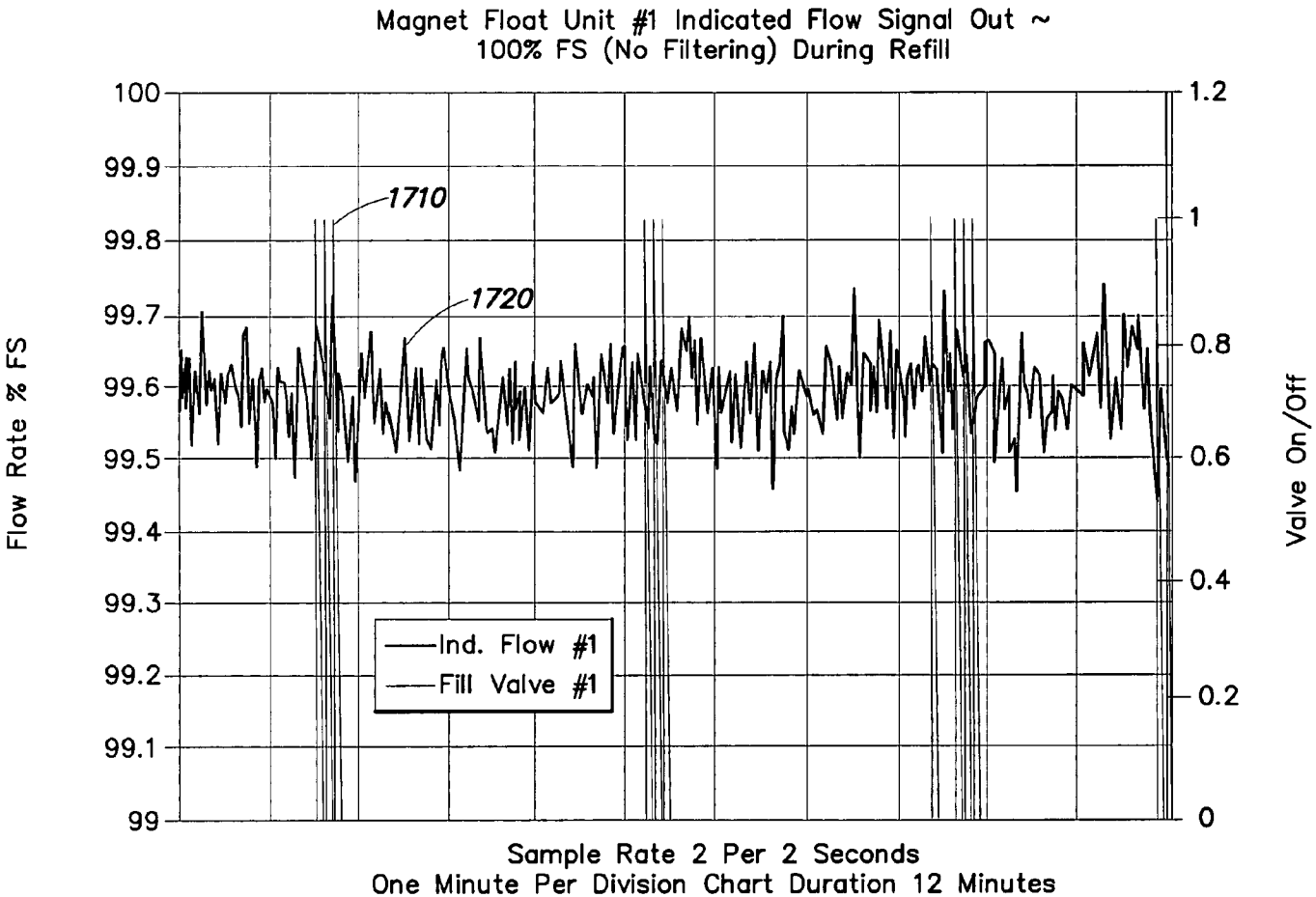

FIG. 17 is a graph depicting the stability of vapor flow during operation of one embodiment of the present invention. In FIG. 17 line 1710 represents the state of fill valve 124, where fill valve 124 and line 1720 represents the flow rate as a percentage of FS of the embodiment of the device. Notice that line 1720 fluctuates substantially the same amount during refill periods (indicated by line 1710) as outside of these refill periods.

Figure 18:
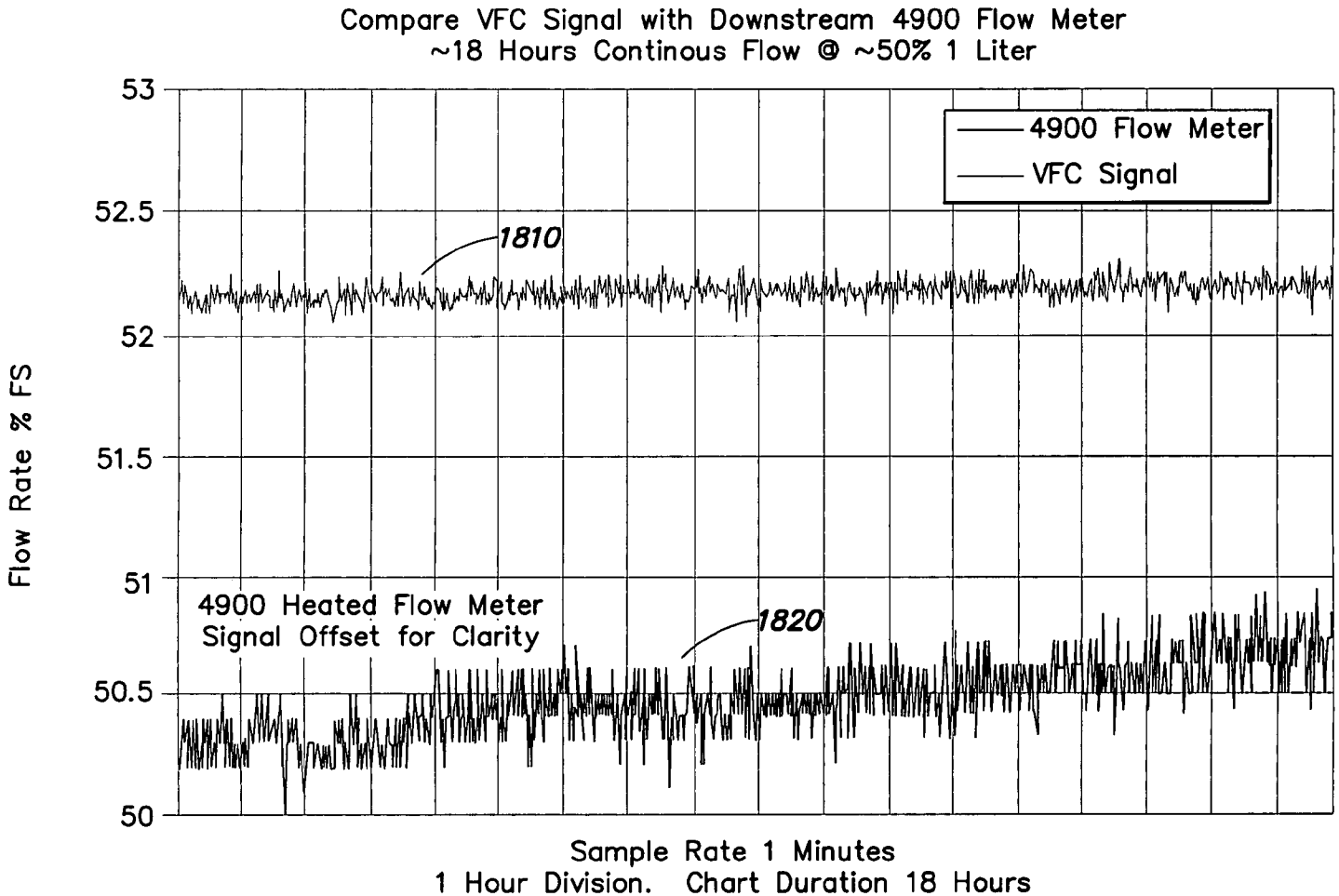

FIG. 18 is a graph depicting the vapor flow sensed by mass flow controller 180 compared with the vapor flow measured by a mass flow meter downstream of mass flow controller 180 during operation of embodiments of the present invention. Line 1810 represents an output signal representative of the flow rate (as a percentage of full scale) measured by mass flow controller 180 while line 1820 represents an output signal representing flow rate measured by the downstream mass flow meter. Notice the stability of line 1810 representing the output signal in comparison with the output signal of the downstream mass flow meter.

Figure 19:
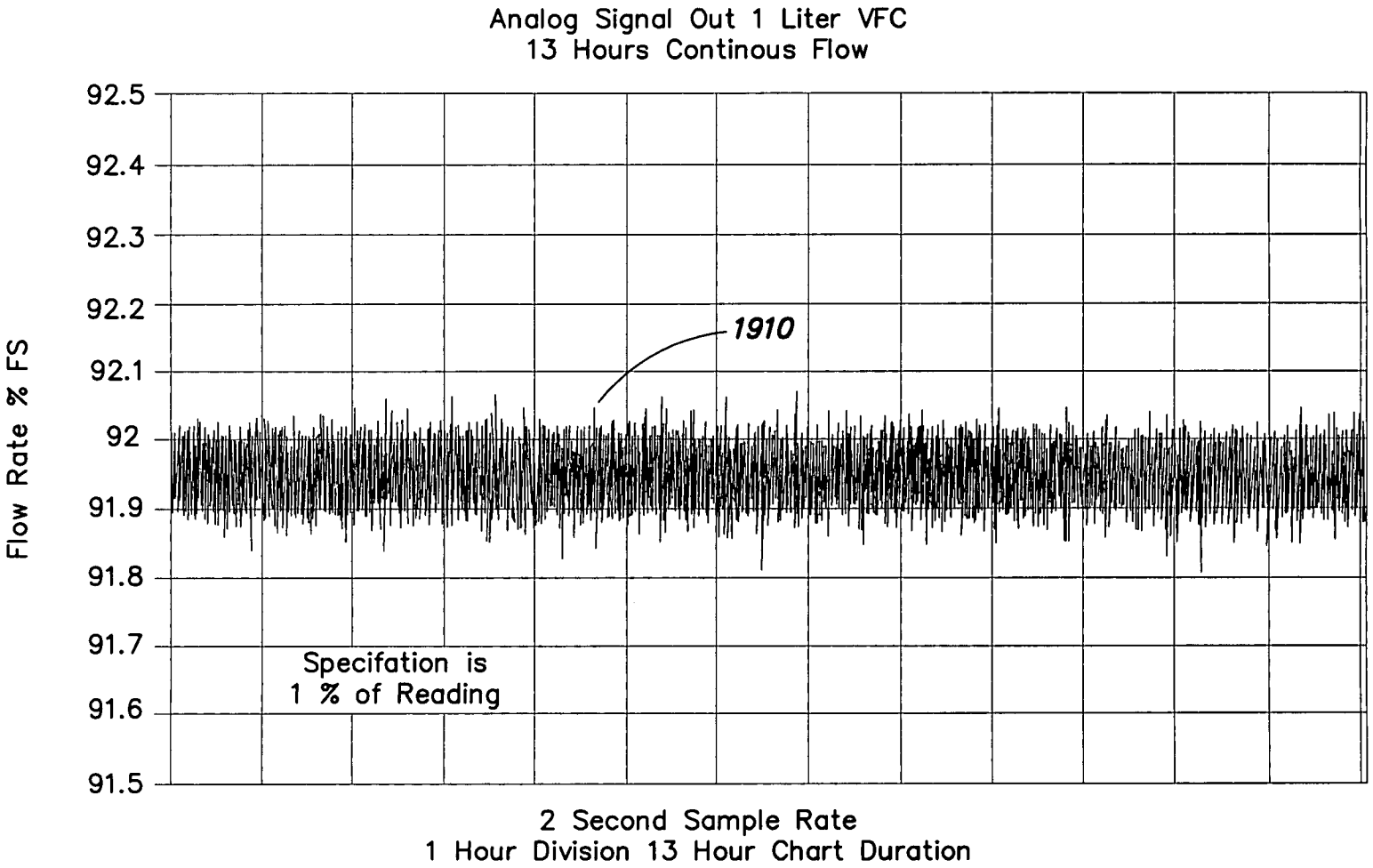

FIG. 19 is a graph depicting the flow stability of one embodiment of the present invention operating at 90% of FS over a 13 hour period. Line 1910 represents the analog signal output representing the flow rate measured at mass flow controller 180. Notice that this analog signal output is relatively stable to less that 1% of reading.

Finally, FIG. 20 is a table depicting the accuracy of an embodiment of vapor delivery system 100. The accuracy of some of these embodiments may be better than one percent of setpoint or reading.

Although the present invention has been described in detail herein with reference to the illustrative embodiments, it should be understood that the description is by way of example only and is not to be construed in a limiting sense. It is to be further understood, therefore, that numerous changes in the details of the embodiments of this invention and additional embodiments of this invention will be apparent to, and may be made by, persons of ordinary skill in the art having reference to this description. It is contemplated that all such changes and additional embodiments are within the scope of this invention as claimed below.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component of any or all the claims.

What is claimed is:

1. A method for producing and flowing vapor from a liquid, comprising:

heating a vaporizer tank to substantially a first operating temperature to produce vapor from the liquid, wherein at the first operating temperature, the vapor in the vaporizer tank is substantially saturated;

regulating a flow of the vapor to achieve a vapor flow rate; and controlling a fill valve to maintain a level of the liquid in the vaporizer tank between an overfill level and a minimum level;

wherein heating the vaporizer tank, regulating the flow of vapor, and controlling the fill valve maintain the vaporizer tank at substantially the first operating temperature so that as the flow of vapor is regulated to achieve the vapor flow rate and the fill valve is controlled to maintain the level of the liquid in the vaporizer tank between the overfill level and the minimum level, a pressure in the vaporizer tank is maintained at a substantially constant value above approximately 500 Torr to maintain the vapor in the vaporizer tank in the substantially saturated condition.

2. The method of claim 1, wherein the first operating temperature is around 93° C.

3. The method of claim 1, wherein heating the vaporizer tank comprising controlling a first set of heaters.

4. The method of claim 3, wherein regulating the flow of vapor is accomplished using a mass flow controller.

5. The method of claim 4, wherein the mass flow controller is a thermal based mass flow controller.

6. The method of claim 4, further comprising heating the mass flow controller to a second operating temperature, wherein the second operating temperature is above the first operating temperature.

7. The method of claim 6, wherein the second operating temperature is between 5° C. and 15° C. above the first operating temperature.

8. The method of claim 6, further comprising maintaining the mass flow controller at substantially the second operating temperature.

9. The method of claim 8, wherein heating the mass flow controller to the second operating temperature and maintaining the mass flow controller at the second operating temperature comprises controlling a second set of heaters.

10. The method of claim 9, wherein the first set of heaters in controlled by a first Proportional Integral Derivative (PID) control loop and the second set of heaters is controlled by a second PID control loop.

11. The method of claim 9, further comprising sensing the level of the liquid in the vaporizer tank.

12. The method of claim 11, wherein controlling the fill valve includes controlling the fill valve to admit liquid to the vaporizer tank responsive to the level of the liquid being below an operating level.

13. The method of claim 12, wherein controlling the fill valve to admit liquid to the vaporizer tank comprises:

controlling the fill valve to admit liquid to the vaporizer tank until the level of the liquid reaches the operating level; and controlling the fill valve to admit liquid for a time period after the level of the liquid reaches the operating level.

14. The method of claim 13, wherein the time period is between about 1 second and 5 minutes.

15. The method of claim 13, wherein controlling the fill valve comprises gating the fill valve to achieve a fill rate.

16. The method of claim 15, wherein the fill rate is approximately twice a full scale liquid consumption rate.

17. The method of claim 11, wherein controlling the fill valve includes stopping operation when the level of the liquid in the vaporizer tank has exceeded the overfill level or fallen below the minimum level.

18. A system for producing and flowing vapor, comprising:

a vaporizer tank operable to hold a liquid, the vaporizer tank having a liquid inlet;

a fill valve, coupled to the liquid inlet to permit the liquid to flow into the vaporizer tank;

a first set of heaters coupled to the vaporizer tank to heat the vaporizer tank to substantially a first operating temperature to produce vapor from the liquid, wherein at the first operating temperature, the vapor is substantially saturated;

a mass flow controller coupled to the vaporizer tank operable to regulate a flow of vapor from the vaporizer tank according to a setpoint; and a control system operable to control the mass flow controller to provide the flow of vapor at the setpoint;

to control the fill valve to maintain a level of the liquid between an overfill level and a minimum level; and to control the first set of heaters to maintain the vaporizer tank at substantially the first operating temperature, so that as the flow of vapor is provided at the setpoint and the level of the liquid is maintained between the overfill level and the minimum level, a pressure in the vaporizer tank is maintained at a substantially constant value above approximately 500 Torr to maintain the vapor in the substantially saturated condition.

19. The system of claim 18, wherein the fist operating temperature is around 93° C.

20. The system of claim 18, wherein the mass flow controller is a thermal based mass flow controller.

21. The system of claim 18, further comprising a second set of heaters coupled to the mass flow controller, wherein the control system is operable to control the second set of heaters to heat the mass flow controller to a second operating temperature which is above the first operating temperature.

22. The system of claim 21, wherein the second operating temperature is between 5° C. and 15° C. above the first operating temperature.

23. The system of claim 21, wherein the control system is operable to control the second set of heaters to maintain the mass flow controller at substantially the second operating temperature.

24. The system of claim 23, wherein the control system is operable to control the first set of heaters using a first Proportional Integral Derivative (PID) control loop and to control the second set of heaters using a second PID control loop.

25. The system of claim 23, further comprising a level sensor, wherein the control system is operable to receive a signal from the level sensor indicative of the level of the liquid in the vaporizer tank.

26. The system of claim 25, wherein the control system is operable to control the fill valve to admit liquid to the vaporizer tank responsive to the level of the liquid being below an operable level.

27. The system of claim 26, wherein the control system is operable to control the fill valve to admit liquid to the vaporizer tank until the level of the liquid reaches the operating level, and to control the fill valve to admit liquid for a time period after the level of the liquid reaches the operating level.

28. The system of claim 27, wherein the time period is between about 1 second and 5 minutes.

29. The system of claim 27, wherein the control system is operable to oscillate the fill valve to achieve a fill rate.

30. The system of claim 29, wherein the fill rate is approximately twice a full scale liquid consumption rate.

31. The system of claim 26, wherein the control system is operable to stop operation of the system when the level of the liquid in the vaporizer tank has exceeded the overfill level or fallen below the minimum level.

32. The system of claim 18, wherein the liquid is deionized water, and wherein the control system is operable to maintain the pressure within the vaporizer tank at the substantially constant value between approximately 530-560 Torr.

33. The system of claim 18, wherein the liquid is de-ionized water, and wherein the pressure in the vaporizer tank is maintained at the substantially constant value and varies by no more than approximately 50 Torr.

34. The system of claim 18, further comprising a level sensor, wherein the control system is operable to receive a signal from the level sensor indicative of the level of the liquid in the vaporizer tank, to control the fill valve to admit liquid to the vaporizer tank if the level of the liquid is below an operating level and until the level of the liquid reaches the operating level, to control the fill valve to admit liquid for a time period after the level of the liquid reaches the operating level, and to activate the first set of heaters for a period of time that begins prior to controlling the fill valve to admit liquid to the vaporizer tank and ends after the time period after which the level of the liquid reaches the operating level.

35. The method of claim 1, wherein the liquid is de-ionized water, and wherein heating the vaporizer tank, regulating the flow of vapor, and controlling the fill valve maintain the vaporizer tank at substantially the first operating temperature so that as the flow of vapor is regulated to achieve the vapor flow rate and the fill valve is controlled to maintain the level of the liquid in the vaporizer tank between the overfill level and the minimum level, the pressure in the vaporizer tank is maintained at the substantially constant value between approximately 530-560 Torr to maintain the vapor in the vaporizer tank in the substantially saturated condition.

36. The method of claim 1, wherein the liquid is de-ionized water, and wherein the pressure in the vaporizer tank is maintained at the substantially constant value and varies by no more than approximately 50 Torr.

37. The method of claim 3, further comprising sensing the level of the liquid in the vaporizer thank, wherein:

controlling the fill valve includes controlling the fill valve to admit liquid to the vaporizer tank responsive to the level of the liquid being below an operating level and until the level of the liquid reaches the operating level; and controlling the fill valve to admit liquid for a time period after the level of the liquid reaches the operating level;

wherein controlling the first set of heaters includes activating the first set of heaters for a period of time that begins prior to controlling the fill valve to admit liquid to the vaporizer tank and ends after the time period after which the level of the liquid reaches the operating level.

38. A method for producing and flowing vapor from a liquid, comprising:

heating a vaporizer tank to substantially a first operating temperature to produce vapor from the liquid, wherein at the first operating temperature, a substantially saturated vapor condition is produced in the vaporizer tank;

regulating a flow of the vapor from the vaporizer tank to achieve a vapor flow rate; and controlling a fill valve coupled to the liquid inlet of the vaporizer tank to control the flow of liquid into the vaporizer tank to maintain a level of the liquid in the vaporizer tank between an overfill level and a minimum level;

wherein heating the vaporizer tank, regulating the flow of vapor, and controlling the fill valve maintain the vaporizer tank at substantially the first operating temperature so that as the flow of vapor from the vaporizer tank is regulated to achieve the vapor flow rate and the fill valve is controlled to maintain the level of the liquid in the vaporizer tank between the overfill level and the minimum level, a pressure in the vaporizer tank is maintained at a substantially constant value above approximately 500 Torr to maintain the vaporizer tank in the substantially saturated condition.

* * * * *